United States Patent [19]

Bohn

[11] Patent Number: 4,753,293

[45] Date of Patent: Jun. 28, 1988

[54] PROCESS FOR RECOVERING PETROLEUM FROM FORMATIONS CONTAINING VISCOUS CRUDE OR TAR

[75] Inventor: Jack R. Bohn, Rancho Palos Verdes, Calif.

[73] Assignee: TRW Inc., Redondo Beach, Calif.

[21] Appl. No.: 340,146

[22] Filed: Jan. 18, 1982

[51] Int. Cl.[4] ..... E21B 43/04; E21B 43/24; E21B 43/40

[52] U.S. Cl. ..... 166/267; 166/272; 166/278; 166/303

[58] Field of Search ..... 166/267, 276, 278, 272, 166/303, 306

[56] References Cited

U.S. PATENT DOCUMENTS

| | | | |
|---|---|---|---|
| 2,412,765 | 12/1946 | Buddrus et al. | 166/303 X |
| 2,862,558 | 12/1958 | Dixon | 166/272 |
| 2,881,838 | 4/1959 | Morse et al. | 166/306 X |
| 3,882,941 | 5/1975 | Pelofsky | 166/303 |
| 3,964,547 | 6/1976 | Hujsak et al. | 166/303 X |
| 4,067,391 | 1/1978 | Dewell | 166/303 |
| 4,085,803 | 4/1978 | Butler | 166/303 |
| 4,114,687 | 9/1978 | Payton | 166/303 X |
| 4,124,074 | 11/1978 | Allen | 166/278 |
| 4,127,170 | 11/1978 | Redford | 166/272 X |
| 4,362,213 | 12/1982 | Tabor | 166/303 X |

*Primary Examiner*—George A. Suchfield
*Attorney, Agent, or Firm*—Benjamin DeWitt

[57] ABSTRACT

A process for recovering petroleum from relatively impermeable formations. A permeable structure is formed to extend radially outward from the well bore and vapor, including solvent vapor, is introduced in a manner to condense primarily adjacent petroleum-containing portions of the formation, thereby forming a mixture of solvent and petroleum sufficiently mobile to flow downwardly and inwardly to a lower portion of the well bore leaving in place a leached volume of solids from which most of the petroleum has been removed.

43 Claims, 5 Drawing Sheets

PROCESS FOR RECOVERING PETROLEUM FROM FORMATIONS CONTAINING VISCOUS CRUDE OR TAR

BACKGROUND OF THE INVENTION

My invention relates to in-situ solvation processes for recovering heavy oil from tar sands and heavy oil deposits that are not economically producible by conventional primary or secondary recovery techniques and, more specifically, to a method employing in-situ condensation of solvent vapor for recovering hydrocarbons, economically, from subterranean viscous petroleum formations such as the tar sands in Alberta, Canada and the heavy oil deposits of eastern Venezuela.

Around the world, there are many petroleum bearing formations from which the oil cannot be recovered by conventional means because the oil is so viscous that it will not flow from the formation to a conventional oil well. Examples of such formations are the bitumen-bearing tar sand deposits in Canada and in the United States, and the heavy oil deposits in Canada, United States, and Venezuela. In these deposits, the heavy crudes are so viscous, under the prevailing temperatures and pressures within the formations, that the oil flows very slowly or not at all in response to the force of gravity. In such formations, heavy crudes are intimately associated with sand particles and water in a dense, immobile, mass. Moreover, formations of this kind are substantially impermeable to gases and liquids; for example, in their undisturbed state, the tar sands in the vicinity of Asphalt Ridge, Utah, have a gas permeability of about 0.05 Darcy. These formations usually are not amenable to conventional secondary recovery techniques such as water flooding or steam drive processes.

Tar sand deposits usually consist of fine sand in which each sand grain is coated with a layer of water and bituminous material occupies most of the void space between the wet sand grains. The deposit usually has a void volume of about 25 to 35%. The interstices between the sand grains are filled with bitumen and water and occasionally a small amount of gas, usually air or methane.

Several such tar sand deposits, around the world, are estimated to contain about 3000 billion barrels of heretofore unrecoverable oil. This is much more than the world's total conventionally recoverable oil reserves. The Athabasca deposit alone, one of four such deposits in Alberta, is one of the largest accumulations of petroleum in the world, at least four times as large as the largest conventional oil field, Ghawar, in Saudi Arabia.

In southeastern Utah, the Permian formation Tar Sand Triangle is estimated to contain about 12 billion barrels of oil. Another 10 billion barrels are located in other places in Utah. Other heavy oil deposits, amounting to at least 25 billion barrels in the aggregate, are present elsewhere in the United States, primarily in Texas and California. In eastern Venezuela, the Orinoco heavy oil belt is believed to contain over one trillion barrels of oil.

In the Alberta tar sand deposits, the formation is generally uncemented sand saturated with a heavy tar-like bitumen having an API gravity of 6° to 11°. Less than 10% of the Alberta tar sands is shallow enough to permit economic recovery by strip mining. For example, two thirds of the Athabasca deposit has over five hundred feet of overburden; and it is not presently feasibly economic to strip mine at depths over about 150 feet. Hence, most of the Athabasca deposit is currently awaiting the development of an economically feasible in-situ technology for the recovery of bitumen.

In the prior art, various in-situ processes have been proposed for recovering oil from tar sand deposits. These include in-situ combustion techniques and various steam drive processes. These techniques are largely frustrated by difficulty in forcing hot water or steam horizontally through the deposit. When one attempts to force steam horizontally from an injection toward a production well the tar sand is contacted at the front of the steam by hot-water condensate which apparently softens the adjacent tar sufficiently to form an impervious barrier. Once this gas-tight layer is created it cannot be usefully penetrated even by noncondensible gas at pressures so high that rupture of the overburden becomes a hazard. This "plugging" of the flow path between the injection and production wells also frequently frustrates in-situ combustion schemes; steam generated at the fire front, in some instances, apparently moves forward into the tar and condenses to form a softened-tar barrier so gas tight that combustion-sustaining air cannot be fed to the fire front. While these steam drive and in-situ combustion techniques may prove to be quite useful for stimulation of high permeability oil reservoirs, they clearly have not succeeded commercially in the Canadian tar sands. Pilot operations, using "huff-and-puff" techniques, have proved to be economically unacceptable for extraction of Canadian tar sands; the average oil production rates achieved are not high enough to justify the required investment, working capital and thermal losses.

Thus, it is generally recognized that thermal stimulation alone is not effective at present for efficient recovery of bitumen from the Canadian tar sands. In addition, steam and combustion processes, which as typically practiced supply only heat, do not provide definitive containment of the mobilizing fluids within the boundaries of the resource from which it is desired to extract petroleum; they waste massive amounts of heat energy. Further, provisions for fluid contact with the resource tar, in steam drive processes, must be augmented by fracturing of the formation or the employment of high pressures often exceeding the lithostatic pressure of the formation. The heating medium, usually steam, must be supplied at extremely high temperatures and pressures in order to adequately reduce the viscosity of the tar. In many resources the heavy crude lies well below 2000 feet; and it is generally uneconomic to deliver high quality steam to such depths. Also, the high pressures required in steam drive processes generally preclude the use of these techniques in shallow resources where the high pressure would risk rupturing the overburden. In short, to the best of my knowledge, there is no economically successful steam drive, in-situ combustion, or "huff and puff" technique presently being used on a commercial scale for the production of petroleum from the Canadian or Venezuelan tar deposits. In-situ production of petroleum from these tar and heavy oil deposits awaits the development of an effective, economical, and controllable in-situ recovery method for producing these resources with good sweep efficiency.

Mobilization and production of tar from the tar sand deposits is best accomplished by using a working fluid which has the power to reduce the viscosity of the tar by several orders of magnitude. A working fluid which can simultaneously deliver thermal energy and solvation to the tar-containing portion of the resource would meet this requirement, provided that inter-action of the working fluid with the resource is properly controlled and optimized. The following conditions must be met:

A solvent having a high capacity for reducing the viscosity of tar must be delivered to the extraction interface in a manner such that no significant in-transit loss of the solvent occurs and such that substantially all of the heat carried by the solvent is deposited close to the extraction interface.

Heat transfer and mass transfer rates must be regulated so that the rate at which thermal energy is deposited at the extraction interface closely matches the sum of the rates at which thermal energy is lost by conduction to the surrounding resource and is carried away by the mobilized product-solvent-water-mixture.

The resulting liquid mixture of tar, water, and liquid solvent must be sufficiently low in viscosity to flow to a collection point for removal to the surface by conventional techniques.

The environment must be left in a satisfactory condition.

To the best of my knowledge, there is no prior art process that meets the foregoing requirements. My invention does.

Further, it is to be understood that the present invention, while having outstanding advantages for recovery of bitumen from the Canadian tar sands, is not limited to use in such resources. It provides a practical, economically attractive method for producing oil from substantially any tar-containing or heavy crude-containing formation where the oil in its native state has a viscosity such that it does not readily flow to a conventional production well, and has potential application wherever the characteristics of the formation are such that conventional secondary and tertiary recovery techniques are not commercially feasible. To facilitate full understanding, however, my invention is described in the following by reference specifically to its use in recovering bitumen from tar sand deposits. In my process in-situ condensation of a mixed vapor is used to simultaneously heat and dissolve the tar so that the bitumen or heavy oil will flow from the sand in which it is found without disturbing the fabric of the sand. Both thermal stimulation and the solvation action operate to reduce the viscosity of the hydrocarbons. In accordance with my invention hot vapor of a hydrocarbon solvent, mixed with water vapor, is fed into a permeable initiation zone disposed within the formation. The heat content of the mixed vapor is controlled so that the vapor condenses closely adjacent to heavy crude-containing portions of the formation. Preferably, the heat content of the mixed vapor is sufficiently high so that substantially all of the mixed vapor is in saturated vapor form as it reaches the interface between the tar-containing resource and the previously-leached, cleansed-sand volume. More preferably, the heat content is sufficiently high that substantially all of the mixed vapor approaches this interface at a temperature incrementally higher than its condensation temperature. Under these conditions, substantially all of the mixed vapor condenses at the radial extremities of the leached volume, i.e. at the periphery of the portion of the formation which has been stripped, previously, of its heavy crude content. At or closely adjacent to this extraction interface, the mixed vapor condenses, releasing its remaining superheat, if any, and its latent heat of vaporization. The so-deposited thermal energy heats the crude-containing formation at and beyond the extraction interface and the hydrocarbon-solvent component of the condensate mixes, by mass diffusion, with heavy crude at the extraction interface to form a solvent/crude mixture in a mixing zone. By the combination of the solvency action and thermal stimulation the viscosity of the tar decreases several orders of magnitude, sufficiently so that the solution of tar dissolved in condensate flows, by gravity, downwardly along the mixing zone adjacent the extraction interface toward a sump at the bottom of a well bore. From there, the mixture or solvent condensate and heavy crude is recovered to the surface, where the solvent and crude are separated from each other and, preferably, the mixed solvent is recycled repeatedly for recovery of more heavy crude from the formation.

Accordingly, it is a primary object of my invention to provide an economic in-situ recovery method for heavy crudes and bitumen that operates within a closed, porous volume surrounded by substantially impermeable, cold tar sand and which exploits the advantages of the use of vapor of a hydrocarbon solvent mixed with some water vapor.

SUMMARY OF THE INVENTION

In accordance with one aspect of my invention, my process involves the introduction and circulation, within a closed porous volume in the tar sand resource, of a mixture of hot hydrocarbon-solvent vapors and water vapor. Stimulation of the resource is accomplished, in-situ, when this working vapor is drawn to the periphery of the leached volume to condense there, as an azeotrope, and heat and dissolve the bitumen contained in the pores of the tar sand. The viscosity of the contacted bitumen is reduced both by the solvency action and by the latent heat of the mixed solvent. Consequently, a mobilized solvent/bitumen mixture flows by gravity along the periphery of the leached volume downward to a sump at the bottom of the well bore. From there, the liquid is pumped to the surface for subsequent refining as a valuable product. The leached volume, above the pool in the sump, is not filled with liquid but contains some steam and solvent, primarily in vapor form.

In accordance with another aspect of my invention, I provide within the bitumen-bearing formation a porous structure surrounding the well bore and formed of a material substantially impermeable to solids and viscous tar while being permeable to liquids and gases. This structure, which I call the initiation zone, has a substantial vertical length, preferably at least an order of magnitude longer than its cross-sectional diameter. It serves as a means for uniformly distributing heated solvent vapor, over a considerable vertical interval, to the periphery of a leached volume in a manner such that the inflowing vapor contacts, substantially equally, all portions of a large area of the extraction interface. At the same time, this permeable structure provides a path by which condensate mixed with dissolved tar may flow downwardly to a sump at the bottom of the well bore for removal to the surface. This initiation zone also provides physical support to the cleansed sand in the leached volume so that swelling of the thermally-stimulated resource does not cause slumping and plugging of the foraminous tubing by which the hot solvent vapor is introduced into the initiation zone.

Another important feature of my process is the manner in which leaching is initiated. In conventional steam drive, huff-and-puff, and solvent flooding methods it has been the common practice to complete a well and, then, immediately inject steam and/or solvent with whatever driving pressure is necessary to force the working fluid through and beyond the air and other non-condensable gases trapped in the well bore. Leaching with hot solvent vapor may be started and operated much more efficiently by first purging the well bore and the initiation zone of substantially all non-condensable gas, and heating the initiation zone to near the desired operating temperature of the process. After completing a well, including implacing the initiation zone, I fill the completion with liquid, preferably hot hydrocarbon solvent or hot water, or some of each. Pumping of liquids from the bottom of the hole is started; and, simultaneously, hot solvent vapor is allowed to flow into the well bore and the initiation zone volumetrically replacing the liquids. This vapor preferably is a mixed vapor comprising steam and hydrocarbon-solvent vapor. Condensation of steam and/or solvent vapor in the initiation zone induces downflow of additional vapor and rapid delivery of thermal energy to the initiation zone until it becomes substantially isothermal. At this time the system approaches a quasi steady state condition in which condensation occurs substantially only at the periphery of the permeable initiation zone and closely adjacent the surrounding tar sand or heavy-oil-containing formation. Condensation occurs, thereafter, at a rate governed by the sum of the rates at which thermal energy is conducted away through the surrounding formation and carried away by the produced liquids; and the mass flow rate of vapor into the initiation is determined by the condensation rate, plus the amount of additional vapor required to fill the slowly increasing volume of the leached volume as it grows larger.

DESCRIPTION OF THE DRAWINGS

The present invention can better be understood by reference to the drawings, in which.

As noted heretofore, and as will be discussed in greater detail hereinafter, the preferred embodiments of my process employ a mixed vapor which includes vapor of a hydrocarbon solvent and a substantial amount of water vapor. In some implementations of the process, the mixed vapor is an azeotropic mixture or a near-azeotropic mixture of water vapor and solvent vapor. The physical principles of my process are better understood, however, by initially considering a somewhat simplified, diagrammatic arrangement employing hydrocarbon solvent vapor without steam being added.

Figure 1:
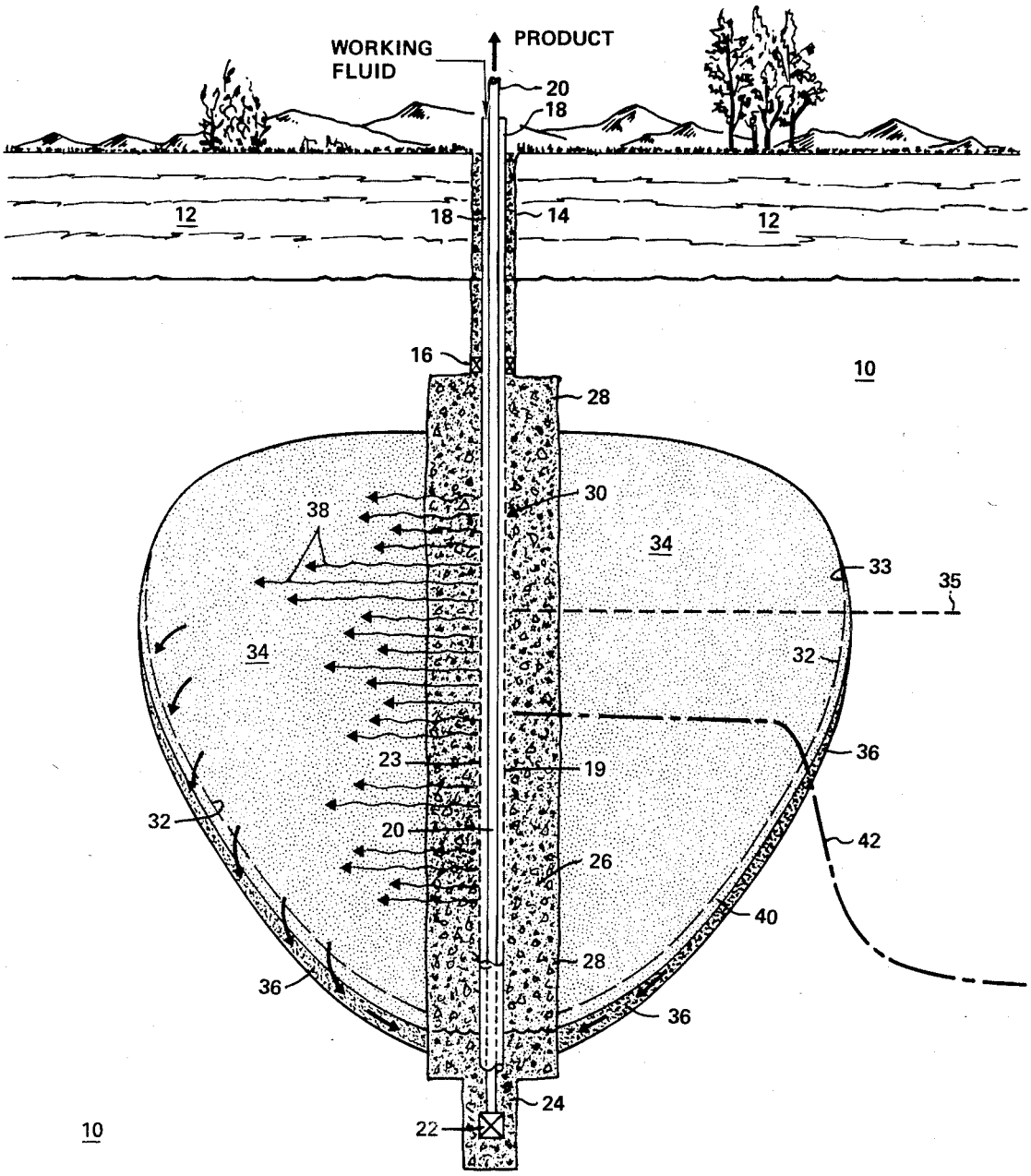
FIG. 1 is a schematic, vertical, sectional view of a single well bore extending into a tar sands formation where my process is operating.

FIG. 1 shows a tar sand formation 10 located beneath overburden 12, which may be up to several thousand feet thick. In its undisturbed state the formation 10 is substantially impermeable to the flow of liquids or gases, and has a temperature of about 50° F. near the surface, ranging upwardly to geotechnic temperatures at greater depths. Hole 14 extends through overburden 12 and nearly to the bottom of formation 10. Within hole 14 are a packer 16, casing 18, well bore liner 19 and tubing string 20. At the bottom of tubing 20 is pump 22 with an intake extending into sump 24 at the bottom of the hole.

The space 26 around liner 19 is filled with a substantial quantity of gravel and sand, to form a gravel-pack initiation zone 28 preferably extending from the bottom of the bore hole to packer 16.

Well bore liner 19 is slotted, or otherwise foraminated, over a selected vertical interval 30 to thereby function as a means for introducing solvent vapor to the initiation zone 28 through vertically distributed apertures; preferably the foraminated portion 30 extends from near the top of the pay zone downwardly to a point somewhat above the highest liquid level expected in the sump 24. This forms an elongated, vertically extended source of solvent vapor introduction to thereby provide for significantly improved leaching of the tar-sand resource at substantially the same rate over a considerable vertical extent of the interface 32 (e.g. 50 to 100 feet, vertically). The initiation zone 28 preferably extends, vertically, over the entire length of the slotted portion 30 of the liner and downwardly to the bottom of the hole, surrounding the pump assembly 22 in the sump 24, and upwardly to packer 16. Thus, the initiation zone 28 is substantially cylindrical, and extends vertically about as far as the vertical interval of the resource that I wish to leach. The initiation zone preferably fills, completely, the inter-space between liner 19 and the walls of borehole 14; accordingly, it prevents slumping of solids from formation 10 toward the liner 19. More importantly, initiation zone 28 functions as a horizontally and vertically permeable means for permitting solvent vapor to flow from liner 19 to the undisturbed-tar-sand interface and for permitting a mixture of condensate and dissolved tar to flow downwardly to the sump at a distance from the foraminated liner.

OPERATION

A unique and important feature of my process is the manner in which hot solvent vapor is initially introduced into the initiation zone and from there to the bitumen-containing sand at the periphery of the initiation zone, where it condenses to dissolve bitumen from the resource. To start my process, substantially all non-condensible gases should be removed from the downcomer annulus 23 and the initiation zone 28. To this end, the initiation zone 28 and the annulus are first filled with hot water along with about 15 to 20 barrels of solvent, such as naphtha. All gases displaced during this filling are flared at the surface. Pumping is started to begin removing liquids by way of sump 24, pump 22, and tubing 20. Simultaneously, hot solvent vapor. from a surface-located vapor source, is introduced through the downcomer annulus 23 and by way of the apertures in foraminated liner 19 outwardly into the permeable initiation zone 28. Introduction of this working vapor is continued while the liquid level in the initiation zone is drawn down to a few feet above the top of the sump 24. Condensation of vapor in the initiation zone induces the flow of additional vapor until the initiation zone becomes substantially isothermal. As the liquids in the initiation zone are drawn down, the permeable material therein will be at a temperature substantially below the operating temperature of my process. For this reason, it is important that the inflow of working vapor be limited to avoid filling the pore space of the initiation zone with liquid condensate. Specifically, the vapor inflow rate should be limited to a mass flow rate substantially lower than the mass flow rate at which condensate will drain down through the initiation zone toward the sump 24. In addition, the capacity of pump 22 should be substantially greater than the mass flow rate at which liquid condensate drains into the sump 24.

Alternatively, one may thoroughly purge the initiation zone of noncondensible gases, before commencing the introduction of working vapor, by circulating steam or solvent vapor through it until it is swept of noncondensable gases and approaches the desired process operating temperature.

During the start up transient condition, condensation of vapor in the initiation zone deposits thermal energy at any colder portion thereof until the entire initiation zone becomes substantially isothermal. Thereafter, condensation occurs substantially only at the tar-sand interface peripherally adjacent the initiation zone, and the solvent condensate diffuses into and mixes with bitumen from the resource to form a downwardly flowing stream of liquids contiguously adjacent to the as yet unleached portions of the resource. Pumping of liquids from the sump 24 is continued either continuously or intermittently to maintain the pool of liquids, in the sump, between predetermined minimum and maximum levels, not more than a few feet above the top of the sump. Thus the operation of my process is brought from start up to a quasi steady state condition in which the inflow of hot solvent vapor from the foraminous liner 19 to the periphery of the initiation zone 28 takes place along the entire length of the initiation zone; and the mass flow rate of vapor is continuously determined by the rate of condensation at the periphery of the initiation zone. Under these near steady state conditions, the inflowing solvent vapor travels through the permeable initation zone 28 without significant condensation occuring and condenses only at the unleached cylindrical surface of the substantially impermeable tar sand 10. Specifically, condensation will occur only where the inflowing vapor encounters resource constituents that are incrementally colder than vapor-saturation temperature for the local pressure existing at the periphery of the initiation zone.

Condensation along the periphery of the initiation zone 28 deposits latent heat into the adjacent tar; the resulting condensate diffuses into and mixes with the tar. Thermal stimulation of the tar causes local swelling of the resource constituents, thereby augmenting mixing of the condensate with the resource tar. The resulting solvent/crude mixture flows downwardly through the periphery of the initiation zone adjacent to and along the surface of the surrounding, tar containing formation. As the leached volume 34 grows, radially, mixing zone 36 defines the periphery of a nearly isothermal, permeable body depleted of tar that extends from foraminous liner 19 radially outward to interface 32. Because substantially all of the bitumen is removed without disturbing the fabric of the sand, the solid material left in place in this leached volume 34 has a permeability of the order of 500 to 2000 millidarcies and, therefore, exhibits negligible impedance to the flow of incoming vapor from the initiation zone towards the interface 32. Continuing condensation, under quasi steady state conditions, at the boundary of the leached volume 34, produces condensate that penetrates into, mixes with, and mobilizes the tar by a combination of solvation and thermal diffusion, thereby producing a solvent-/heavy crude/water mixture in mixing layer 36 that continuously flows downwardly under the influence of gravity to sump 24.

The crude-depleted region, leached volume 34, comprises substantially clean sand from which essentially all of the tar, but not necessarily all the water, has been removed; it is maintained nearly isothermal throughout its volume; and it tends to grow, radially, to a shape approximating a paraboloidal solid, or apple-shaped, figure of revolution more or less axisymmetric about the vertical axis of bore hole 14. It has a permeability at least several orders of magnitude greater than that of the undisturbed tar sand 10 outside mixing zone 36.

Solvent vapor, introduced through initiation zone 28, flows radially along lines 38 to interface 32 where it releases its superheat, if any, and condenses to release and deposit its latent heat of vaporization. The so-deposited heat softens the tar at mixing zone 36 and liquid solvent diffuses into, mixes with, and mobilizes the tar or heavy crude. The sensible heat carried by the solvent vapor preferably is sufficient to assure that the vapor approaches mixing zone 36 in substantially single-phase vapor form.

The vapor side or inner boundary 32 of mixing layer 36 remains, during near steady-state operation, substantially at the condensation temperarture of the vapor. The undisturbed tar sands 10 adjacent the outer boundary of layer 36 is warmed, by thermal diffusion, above formation temperature. Accordingly there is a substantial temperature gradient across mixing zone 36 as indicated by temperature-profile line 42. At any point in zone 36, the viscosity of the liquid mixture depends on temperature and the concentrations of water, solvent and tar in the mixture.

After operating for about two years at near steady-state conditions, as described above, leached volume 34 may have, for example, a diameter of the order of 100 feet as shown in FIG. 1. Because the undisturbed formation 10 has nearly negligible permeability, leached volume 34, enclosed by the surrounding formation, may be considered a closed system peripherally sealed by a layer of semi-mobilized tar, within a relatively cold body of infinite thermal capacity to which heat energy is transferred by conduction only. And the rate at which heat is conducted to the surrounding formation prescribes the rate at which condensation occurs at the periphery of the leached volume.

My process may be better understood by considering the thermodynamic and fluid-dynamic conditions prevailing within the vapor-filled, leached volume 34 after the system of FIG. 1 has been operating for about two years. At such time the production zone has reached near-steady-state thermodynamic conditions; leached volume 34 is substantially isothermal throughout its extent, and is filled with a mixture of water vapor and hydrocarbon solvent vapor. Condensation is occuring substantially only within a relatively thin condensation zone 40 adjacent interface 32. When an incremental quantity of the vapor condenses at interface 32, this condensation results in a slight decrease in the local vapor pressure, causing vapor to flow toward this location. Thus, under steady state conditions vapor is condensing, continuously, adjacent interface 32 and the condensation draws vapor flow to it so that there is a continuous flow of vapor from the initiation zone 28 outwardly through the leached volume (e.g. along lines 38) to the condensation zone 40. Solvent vapor is not forcefully injected into or driven into the leached volume; rather, it flows on a demand basis only in response to the consumption of vapor by condensation along the interface 32. The surface-located vapor-supplying apparatus maintains a controlled pressure within the initiation zone and, specifically, does not attempt to control the vapor mass flow rate; the mass-flow rate of solvent vapor depends on the natural tendency of the system to maintain isothermal conditions throughout the leached volume; if, for example, the enthalpy of the in-flowing solvent vapor were allowed to decrease gradually so that it became incrementally lower than that necessary to supply all heat losses from the closed system, this decrease soon would be reflected by incremental cooling of the cleansed sand in the condensation zone 40. The cooler sand grains immediately induce condensation at their surfaces and a gentle "fog" of solvent vapor occurs in any such minutely cooler portion of the leached volume—until enough latent heat of vaporization has been deposited to corrent the inequality and re-establish isothermal conditions. In summary, condensation occurs substantially only along a relatively thin condensation zone 40 adjacent mixing zone 36, where the cleansed sand loses heat by conduction to the much colder heavy-crude resource 10.

As indicated by curve 42, FIG. 1., there is at all times substantial thermal gradient across mixing zone 36. Heat flow along this gradient is the primary driving mechanism that determines, for a given operating temperature and pressure, the rate of solvent vapor condensation and the consequent vapor mass-flow rate along lines 38 from the initiation zone.

Preferred implementations of my process employ a working vapor which includes vapor of a solvent for heavy crude and a substantial amount of water vapor, such as a mixture comprising steam and at least 40 weight percent vapor of a solvent suitable for dissolving and mobilizing hydrocarbon constituents of the particular resource. The working vapor may be, for example, about 50 mole percent naphtha and 50 mole percent steam. Using such a mixed vapor not only enhances the economics of my process but, also, enables one to manage varying amounts of connate water and provides flexibility for controlling thermodynamic conditions within the leached volume.

Conditions at interface 32 and in the adjacent condensation zone 40 can be regulated by regulating the water content of the mixed vapor and/or by regulating the sensible heat (i.e. superheat) of the working vapor introduced into the downcomer. For example, if it is found that the produced liquids are gradually becoming more viscous than is desired, indicating an undesirably low mixed-solvent to oil ratio ("MSOR") in the mixing zone, this condition may be and should be corrected either by decreasing the water-to-solvent ratio of the incoming vapor or be decreasing the superheat. Decreasing the mole fraction of water in the incoming vapor means that a given mass of mixed vapor carries less latent heat; and upon condensing at interface 32 it delivers less thermal energy. Given the fact that heat dissipation from the interface 32 to the surrounding resource 10 is substantially constant, this decrease in delivered thermal energy per unit mass of vapor means that there will be an incremental increase in the condensation rate at interface 32 and a consequent, small increase in the mass flow rate of the incoming vapor until the rate at which thermal energy is being delivered to the production zone exactly matches the rate at which thermal energy is being dissipated from the production zone into the surrounding resource 10 and carried away by the liquid mixture flowing to the sump. This increased condensation rate produces a corresponding increase in the flow of condensate downwardly in the mixing zone, and a consequent increase in the MSOR. Similarly, one may correct the above-noted condition by decreasing the superheat of the incoming mixed vapor. Reducing the superheat remaining in the vapor as it reaches the condensation zone means that a given mass of solvent vapor, upon condensing at interface 32, will deliver less thermal energy. This results in a slight cooling of the interface 32, a concommitant increase in the condensation rate and a corresponding increase in the flow of liquids downwardly in the mixing zone 36. Thus, the MSOR is increased by decreasing the superheat of the incoming solvent vapor, and regulation of either the superheat or water content of the vapor, as introduced to the downcomer, may be used to control the viscosity in the mixing zone 36, as well as the viscosity of the liquids collected in the sump 24 and pumped to the surface.

The preferred viscosity of liquids draining in the mixing zone will be, generally, dependent on site-specific considerations such as the post-leaching permeability of the particular resource. Satisfactory operation with good drainage of liquids to the sump and without significant risk of plugging is realized by maintaining the MSOR within the range from about 2:1 to about 10:1 in most resources. Economic advantages are realized by maintaining the MSOR at somewhat lower values, especially where the permeability of the cleansed sand in the leached volume is relatively high; in some resources it is preferred to maintain the mixed solvent-to-oil ratio within the range from about 2:1 to about 6:1. Thus, it is seen that regulation of the water content or the sensible heat content of the incoming mixed vapor may be employed to (a) maintain isothermal conditions in the leached volume 34, (b) assure that condensation occurs substantially only within a relatively thin condensation zone adjacent mixing zone 36, (c) regulate the MSOR of the produced liquids, and/or (d) control the rate at which the closed production zone draws down hot vapor from the vapor source located at the surface installation.

In a horizontally-bedded resource the self-contained production zone within formation 10, which includes gravel pack 28, leached volume 34 and mixing zone 36, is substantially axisymmetric around well bore 14. Over the lifetime of the well, this production zone grows from a volume of several hundred cubic feet at startup to several million cubic feet. Because mixing of solvent and heavy crude at the upper and lower portions of interface 32 is less vigorous than at its radial extremities, enlargement of the leached volume 34 principally takes place radially outward. During growth of the production zone, the mass flow rate of mixed vapor will gradually increase to sustain a corresponding increase in the production rate of solvent/heavy crude mixture. To assure this result, the thermal content of the solvent vapor may be controlled, as described above, to maintain the boundary of the isothermal region nearly coincident with the inner boundary of mixing zone 36. By regulating the extent to which the incoming solvent vapor is superheated (i.e. its enthalpy in excess of P,T saturation), vapor condensation is constrained to occur substantially only in condensation zone 40, which extends only a few feet inwardly from interface 32. This enables one to control the shape of the production zone, the MSOR of the liquids in the mixing layer, and the rate of production of pumpable mixture.

Figure 2:
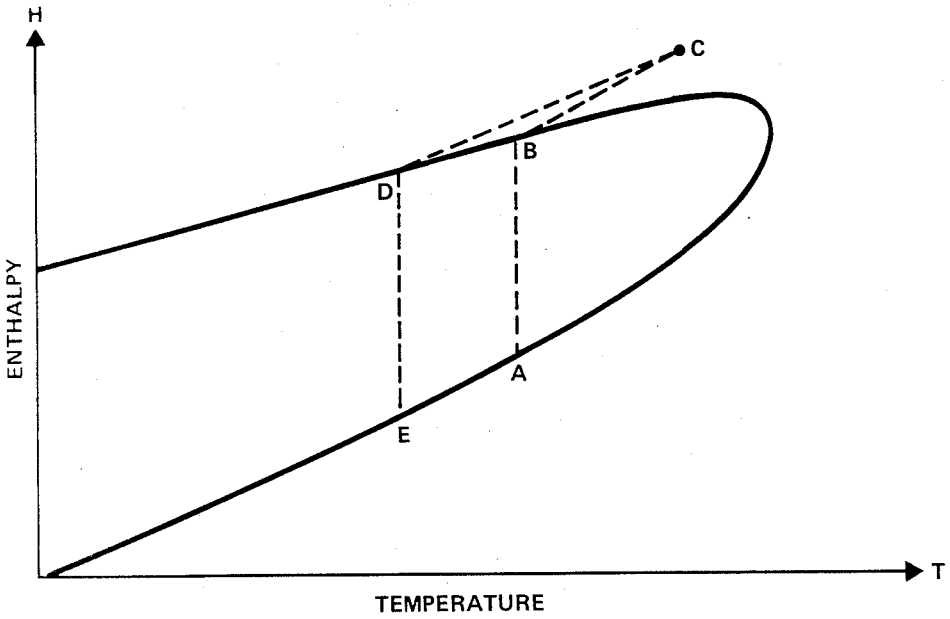
FIG. 2 is a graph of the thermodynamic cycle for a typical solvent in my process, plotting solvent temperature against solvent enthalpy (heat energy content)

FIG. 2 illustrates, graphically, the thermodynamic cycle for a hydrocarbon solvent in my process, plotting solvent temperature against its heat energy content. Point E on the curve EABCD identifies the temperature and heat energy for saturated solvent in liquid form. Adding heat to such solvent raises its temperature from point E to point A, while the solvent remains in the form of a saturated liquid. When the heat content or enthalpy of the solvent is increased further, at constant temperature, the solvent undergoes a phase change and becomes saturated vapor (point B on the graph). Superheating this saturated vapor raises its temperature to point C and increases its volume, but not its pressure.

The solvent is introduced through the well bore and into the leached volume 34 at a temperature represented along line C–D, and surrenders some or all of its superheat as it flows from the point of injection to the interface 32 between leached volume 34 and mixing zone 36. Adjacent this interface 32, the solvent surrenders its remaining superheat, if any, reducing its temperature to point D, and then surrenders its latent heat of vaporization, to become a saturated-liquid condensate having an enthalpy represented by point E in FIG. 2.

Implicit in FIG. 2 are the disadvantages of introducing the working vapor at an unnecessarily high temperature or permitting the temperature of the vapor to fall below the point at which it is less than about 50% saturated vapor. If the heat energy delivered by the working vapor exceeds, substantially, the rate at which thermal energy is conducted away to the surrounding resource 10, the temperature at upper portions 33 of interface 32 will increase until these upper regions are substantially isothermal with leached volume 34; the rate of condensation at areas 33 will decrease until little or no liquid solvent is present at interface 32 above dotted line 35. Under these circumstances any mobilization of heavy crude from the resource 10 above line 35 results primarily from thermal softening, and not from solvation. If desired, this drying of upper portions of the leached volume 34 may be exploited as a technique for limiting the rate of radial growth of the upper portions of the production zone. Along intermediately lower regions of the interface 32, below line 35, a larger fraction of the working vapor condenses, mobilizing heavy crude there by both thermal and solvent stimulation. Because mobilization of heavy crude at areas 33 results, primarily, from thermal viscosity reduction, the leached volume 34 grows more slowly in these areas, and the shape of the resulting production zone becomes more nearly cylindrical than the case where substantially all the solvent reaches the interface 32 as saturated vapor.

Thus, the lower portion of the leached volume 34 can be caused to grow, radially, somewhat more rapidly than the upper portion 33. The effects are to increase the rate of extraction lower in the formation 10, to decrease that rate higher in the formation, and thus to maintain the interface 32 at which extraction is taking place more nearly vertical. To achieve these effects, one may regulate either the superheat or the water vapor/-solvent vapor ratio of the mixed vapor being fed to the initiation zone, without increasing its pressure. In general, gradually increasing the superheat of the incoming vapor will tend toward reducing the leaching rate at upper portions of the interface and this results in the leached volume becoming more cylindrical. Specifically, increased superheat results in a diminution of solvent condensation at upper reaches of the interface, and a consequent tendency toward drying of the interface so that the solvation-action contribution to mobilization of the heavy crude is reduced. Thus leaching slows at these upper areas, the interface 32 tends to become more nearly vertical, and the cylindricity of the leached volume is improved. In deep formations, in order to compensate for thermal losses in the downcomer, it may be desirable to provide supplementary heat energy to the working vapor prior to its release into the initiation zone. This may be accomplished by any one of a variety of down-hole heating devices, such as down hole stream generators, closed-type, currently known in the industry.

COMPOSITION OF THE WORKING VAPOR

In practicing my process, significant advantages are realized by employing, as the working vapor, a mixture of water vapor and hydrocarbon solvent vapor containing from about 5 weight percent to about 60 weight percent water vapor. These advantages may be best appreciated by considering, first, the operational characteristics and effects of using a substantially pure hydrocarbon-solvent vapor and, then, comparing the operation of my process using a preferred mixed vapor.

Assume that one has a field installation generally as described above, operating under quasi-steady state conditions with the incoming vapor from the surface-located equipment being vapor of a hydrocarbon solvent (e.g. naphtha) containing substantially no water and that this vapor is superheated at least enough to offset thermal losses in the downcomer annulus. As this vapor flows through the leached volume 34 and approaches mixing zone 36 its remaining superheat, if any, will be consumed in vaporizing any connate water which has been left in the leached volume 34. The flow of solvent vapor along lines 38 sweeps this newly-generated water vapor toward the mixing zone 36 and tends to hold it in a band within the condensation zone 40. This water vapor layer, adjacent the mixing zone 36, creates a partial barrier, i.e. a modest impedance, through which the incoming solvent vapor must diffuse in order to reach the mixing zone. If a dry hydrocarbon solvent vapor is used as the working fluid, this penetrable, but not negligible, water vapor layer adjacent the mixing zone 36 will be developed in the leaching of any tar sand resource that initially contains more than a negligible amount connate water.

Generally, the above-described water vapor layer is developed early in the life of a well when the leached volume 34 is relatively small. Thereafter, any connate water vaporized by the incoming solvent vapor will be condensed, along with the solvent vapor, at the mixing zone and will flow to the sump in liquid form mixed with the solvent condensate and the extracted oil. Thus, it is not necessary to supply supplementary heat to the process in order to evaporate connate water; a modest amount of supplementary thermal energy is required as sensible heat, however, to raise the temperature of the connate water to that of the produced liquids. Adjacent to the mixing zone, however, the total ambient pressure consists of the sum of the partial pressures of the water vapor and hydrocarbon-solvent vapor. Specifically, near the mixing layer the vaporized connate water forms an azeotrope with a portion of the solvent vapor; for this azeotrope to condense at the mixing layer, the inside surface of the mixing layer must be at the condensation temperature of the azeotrope corresponding to the operating pressure present in the leached volume 34. This lower temperature for P,T saturation at the mixing-zone interface means that the mass diffusivity of the solvent condensate is lower, and the viscosity of the liquids in the mixing zone will be somehwat higher than would be the case in the absence of water. These factors result in a lower leaching rate at the extraction interface.

Another consequence of the above-described water-vapor impedance is a thickening of the condensation zone. With a water vapor layer adjacent to the mixing zone, only a fraction of the solvent condenses directly on the surface of the liquids in the mixing zone, and the remainder condenses within the adjacent water-vapor layer. Since the lower portions of the mixing zone slope inwardly toward the sump, that portion of the solvent which condenses non-contiguously of the mixing layer will drain down through the leached sand and contact the mixing layer lower in the leached volume, but the leaching rate at the upper portions of interface 32 may be somewhat reduced.

To overcome the effects of this water vapor layer, one may increase the operating temperature of the system; but this results in a larger solvent vapor inventory within the leached volume 34 and undesirably increases the solvent/oil ratio of the liquids flowing to the sump. Supplying the incoming solvent vapor at a higher operating temperature would add to the operating expenses of the operation and is, therefore, not desirable. Maintaining a larger solvent inventory in the leached volume is similarly unattractive from a economic point of view. In addition, if dry solvent vapor were used in leaching a relatively very wet resource (i.e. over 20% of the pore volume filled with water), and if the permeability of the leached sand matrix were relatively very low, i.e. less than about 300 millidarcies, the mixing zone 36 might become so burdened with water as to undesirably constrain solvent-diffusion leaching of the tar sand 10 at lower reaches of the mixing zone 36. Accordingly, it will be appreciated that significant advantages can be realized from the use of a leaching strategy which avoids vaporization and transport of connate water and leaves, in place within the leached volume, most or all of the original water content of the resource.

The present invention overcomes the foregoing disadvantages by using, preferably, a mixed vapor comprising vapor of a hydrocarbon solvent mixed with about 5 weight percent to about 60 weight percent water vapor or, more preferably, about 5 to about 30 weight percent water vapor. As described in the following paragraphs, using such a mixed vapor as the working fluid provides a number of significant advantages, including flexibility for controlling the leaching process and major improvements in the economics of the process.

It is well known that a liquid mixture of water and a hydrocarbon solvent, such as benzene or naphtha, when heated, will boil as an azeotrope, at a temperature lower than the boiling-point temperatures of either of the two constituents at the same pressure. Similarly, when a mixture of vapors of two or more such substances condenses, the mixture condenses azeotropically at a temperature lower than the dew point of any one of its components, individually. For example, assuming an operating temperature and pressure of 350° F. and 277 psia, one may readily form a saturated azeotropic vapor consisting of water and hydrocarbon solvent with the respective mole fractions being 0.51 and 0.49.

In practicing my process, one may supply such an azeotrope as the working vapor, either with excess steam added or with excess solvent vapor added. Preferably, one should use a steam-solvent mixture comprising at least 40 mole percent hydrocarbon solvent, or more depending on a number of site specific considerations such as leached-sand permeability, the amount of connate water, and the operating temperature and pressure selected for the specific field program. For reasons that will appear from the following, it may be desirable to supply this mixed vapor to the leached volume 34 with a substantial amount of superheat, sufficient to offset thermal losses in the downcomer annulus and to the overburden above the leached volume 34. When such a mixed vapor is supplied to the leached volume, the condensation temperature at a given operating pressure is substantially lower than the dew points of the hydrocarbon vapor or the steam, considered individually. Accordingly all of the working vapor condenses azeotropically; and, if only one hydrocarbon specie were present in the hydrocarbon solvent component of the mixed vapor, condensation would take place directly at the inner surface of the mixing layer 36. If the hydrocarbon component includes several hydrocarbon species, some fractional condensation will occur with the most volatile specie condensing closest to the mixing layer. As used herein the terms "azeotrope" and "azeotropically" are intended to include not only a conventional azeotropic mixture of water vapor with a single hydrocarbon specie, but also any mixture comprising water vapor and a plurality of volatile hydrocarbons which individually have different dew-point temperatures but which collectively condenses at a temperature lower than than dewpoint of any one of the constituents. Using this mixed solvent vapor as the working vapor is advantageous in that connate water present in the leached volume is not vaporized by the incoming mixed vapor; rather, as tar is removed from the sand and the leached volume grows larger, the connate water drains in the mixing zone 36, along with the water resulting from the condensed steam portion of the azeotrope. The process leaves behind in the leached volume only that amount of water which can be retained by the cleansed sand through capillary action. This amount of water is called the "irreducible level." While the irreducible level of water retained in the leached volume is site-specifically dependent on various factors, such as permeability and operating temperature, it is commonly an amount of liquid water corresponding to about 30% of the pore volume. Thus, in this preferred implementation of my process, as the leaching continues and the leached volume grows larger, the cleansed sand in the leached volume 34 is left containing liquid water substantially at the irreducible level.

The foregoing operation of my process has several distinct advantages. First, since the water vapor component of the mixed solvent has a greater latent heat than the hydrocarbon solvent component, the rate at which heat energy is delivered to the production zone can be regulated, by varying the water/solvent ratio of the working vapor, without altering the vapor mass flow rate. Also the amount of superheat carried by the mixed vapor may be adjusted, if desired, independently of the water-vapor/solvent ratio. For example, over a period of months, the superheat of the incoming mixed vapor may be gradually increased to offset thermal losses to the ceiling of the leached volume as the leached volume grows larger. Alternatively, one may gradually increase the water/solvent ratio of the mixed vapor to compensate for increasing thermal loss to the overburden. More specifically, when an azeotrope plus extra water vapor is supplied to the leached volume 34, the excess water portion condenses first, at a temperature slightly higher than the dew point of the azeotrope. Thus, as a given quantity of mixed vapor approaches the mixing zone 36 it loses part of its water by condensation and its composition is consequently adjusted toward the azeotropic composition that corresponds to the operating temperature being maintained at the inner boundary of the mixing zone. As this quantity of mixed vapor reaches the mixing zone, its composition corresponds to the azeotropic ratio and it condenses at a temperature corresponding to the dew point of the azeotrope.

This action results in a temperature gradient existing along any radius of the leached volume; and the magnitude of this gradient, (i.e. the slope of dashed line 42), is determined by the water vapor/hydrocarbon-solvent vapor ratio of the working vapor which is being introduced into the leached volume. As the leached volume grows larger, the cleansed sand is laden with liquid water to the irreducible level. Thermal energy to offset losses to the overburden above the leached volume is supplied by the latent heat of condensing steam, so that none of the hydrocarbon solvent component is condensed in the cleansed sand region. The small amount of water that condenses at the ceiling to offset thermal loss to the overburden will flow down through the leached sand matrix without deleterious effect. While it is not necessary to superheat this excess-steam mixed vapor, it is permissible to do so; the additional sensible heat represented by the superheat will be consumed in at least partially offsetting heat loss to the overburden, thereby avoiding condensation of water at the ceiling. Consider, for example, a predetermined quantity of superheated working vapor leaving the slotted liner 19 and moving radially outward through the upper reaches of the leached volume 34. As it encounters any portion of the ceiling that is minutely cooler, because of conduction to the overburden, it will first give up part or all of its superheat. And if that is not sufficient to re-establish isothermal conditions as the ceiling, then a portion of the excess water vapor will condense, preferentially, at the ceiling until enough thermal energy is provided to make up for thermal losses to the overburden and the resource above the leached volume. This is an important advantage realized from the use of a mixed working vapor: because the excess water vapor condenses, fractionally, at a temperature somewhat higher than the azeotropic dew point, overburden losses are provided for by condensation of water vapor only; substantially all of the hydrocarbonsolvent component is, therefore, transported to the mixing zone where it is used, more efficiently, in solvation of heavy crude. Draining of hydrocarbon-solvent condensate distantly from the interface is avoided and, thereby, the MSOR in the sump may be minimized. Thus, using superheated vapor consisting of an azeotropic vapor plus extra water vapor plus added thermal energy provides an additional dimension of process design flexibility and an additional means for regulating thermodynamic conditions within the production zone.

Alternatively, one may use as the working fluid an azeotrope with extra hydrocarbon-solvent vapor added; in this case the water content of the incoming vapor is fixed at the level determined by the azeotropic composition and the hydrocarbon-solvent content may be varied independently, above the azeotropic composition. As the inflowing vapor flows through the leached volume, the excess solvent vapor, if superheated, will vaporize irreducible water from the cleansed sand. Near the mixing zone 36 the excess solvent will interact with connate water, adjust itself to the azeotropic composition and condense at the dew-point temperature of the azeotropic. If one elects to use this azeotrope plus extra solvent as the working vapor, it is desirable that the incoming vapor be superheated sufficiently to compensate for thermal losses to the overburden. This choice will avoid condensation of hydrocarbon-solvent vapor at the ceiling of the leached volume, and thereby avoid inefficient utilization of the solvent vapor and/or retention of liquid solvent in the cleansed sand.

In summary, using a steam-solvent mixture comprising at least 40 weight percent hydrocarbon solvent as the working vapor has the following advantages:

Evaporation of water originally present in the resource is avoided; the leached volume is left laden with liquid water to the irreducible water level.

The relatively high latent heat of the water-vapor component minimizes condensation within the leached volume, concentrates the condensation of hydrocarbon solvent contiguously adjacent the mixing zone, and efficiently offsets thermal losses to the overburden.

Water vapor volumetrically substitutes for solvent vapor in the leached volume thereby importantly reducing the solvent-vapor inventory in the leached volume; this significantly improves the economics of the field operation by reducing the required working capital.

It is not necessary to separate all water from the produced liquids; the separated hydrocarbon solvent may be recycled to the well as an azeotrope with either extra water vapor or extra solvent vapor being added, and with or without superheat.

Adjustment of the heat content or the steam-to-solvent-vapor ratio of the mixed vapor may be used as independently controllable parameters for controlling the shape of the production zone, regulating the MSOR in the mixing zone, controlling the tar-extraction rate at the interface, and/or regulating the mass-flow rate of produced liquids.

THE VOLATILE SOLVENT

The composition of the hydrocarbon solvent component of the mixed vapor used in my process can significantly influence the economics of the process. The ideal solvent would be a volatile compound capable of completely dissolving the bitumen and having a narrow boiling point range, such as a naphtha having a 150° to 200° F. true boiling point range at atmospheric pressure. Benzene would also be excellent because of its high volatility and strong solvency power for bitumen. But economic constraints inhibit the use of expensive solvents on a large scale because the leached volume 34 necessarily stores, in vapor form, several million cubic feet of mixed vapor during the final years of the practical life time of a well. Thus, a preferred solvent should be a volatile compound having a narrow boiling point range and which is relatively inexpensive in the vicinity of the specific field program or is producible from the recovered bitumen in nearby processing facilities. In planning a field program one should contemplate using a solvent that can be economically refined from the heavy oil or bitumen produced, or available as a by-product of refining the bitumen to produce a marketable product. For example, in the upgrading processes used for producing synthetic crude from Athabasca bitumen one may produce hydrotreated naphtha and/or raw coker naphtha as by products. In one preferred embodiment of my process I use a low boiling point reformate blended with hydrotreated naphtha. This blend gives a stable solvent having the desired boiling point range and a high aromatic content.

In practicing my process the hydrocarbon solvent should be capable of withstanding operating temperatures of at least 200° to 400° F. without substantial degradation. The operating temperature to be used will normally be selected on a site-specific basis and the amount of superheat, if any, to be used is also site specific. Where the characteristics of the particular resource dictate a relatively high operating temperature it is normally preferred to use aromatics and naphthenes, which are the more stable hydrocarbons. Raw coker naphtha has a high olefin content and is, therefore, a relatively unstable hydrocarbon; it probably should be used only where the preselected operating temperature of the particular well is relatively low.

A narrow boiling point solvent is desirable to minimize fractionation of the solvent in the condensation zone 40. Fractional condensation results in a physically thickened condensation zone as the less volatile components of the solvent condense further from the mixing zone interface 32 and the more volatile components condense directly at the surface of the mixing layer. But using a solvent with a wider boiling point range will allow more extensive use of hydrocarbons derived from the produced bitumen. Thus, in preferred embodiments of my process one should use a solvent having the widest boiling point range that does not result in an excessively wide condensation zone adjacent the mixing layer.

An important consideration in selecting the volatile solvent to be used is predetermination of its desired vapor pressure. The optimum vapor pressure of the hydrocarbon solvent component will depend, on a site specific basis, on the amount of water and non-condensable gas, if any, present in the formation to be leached. Where the pore space of the formation contains more than about 20% water, or significant amounts of non-condensable gas, it is desirable to operate with a higher solvent vapor pressure in order to reduce the fraction of the overall pressure represented by the partial pressure of water vapor water and the non-condensable gas. This selection will diminish the impedance at the condensation zone arising from the presence of water vapor and/or noncondensable gas. Thus, in preferred embodiments of my process I commonly contemplate the use of a hydrocarbon solvent having the highest practical volatility consistent with economics and ability to dissolve substantially all the asphaltene constituents of the particular formation.

While not necessarily a primary consideration, the ability of the volatile solvent to dissolve asphaltene components of the bitumen must be taken into account. Most bitumens contain about 20 weight percent pentane-insoluble asphaltenes, which consist of high molecular weight species containing sulfur, nitrogen, and metal salts. If a solvent having a relatively poor capability for dissolving these materials is used, the asphaltenes will tend to precipitate from the bitumen as it is dissolved or may significantly contribute to the visocity of the dissolved mixture flowing down in the mixing zone. In general aromatic hydrocarbons are good solvents for asphaltenes, while paraffins are not. Thus in preferred embodiments of my process it is desirable to use a volatile solvent containing at least 20% aromatic hydrocarbons. For example, in leaching a specific bitumen deposit, wherein the operating temperature for P,T saturation at the interface is to be 350° F., one may use a volatile solvent consisting of about 20% aromatics, e.g. benzene, and about 80% hexane; or a mixed volatile solvent containing 15 to 25 percent cyclohexane and 70 to 80 percent hexane. In general, with regard to dissolving asphaltenes, naphthenes may be subsituted for aromatics. In summary, where a mixed vapor is used the hydrocarbon component of the mixed vapor need not be more than about 20–25 percent, by weight, aromatics, and I prefer to use an aromatic hydrocarbon content in the range from about 20 to about 30%.

TEMPORALLY VARYING THE COMPOSITION OF THE VOLATILE-SOLVENT COMPONENT

Referring to FIG. 1, it may be noted that the temperature profile, indicated by line 42, is substantially flat across the leached volume 34 until the condensation zone 40 is reached. This is so in embodiments using an azeotrope as the working fluid. In embodiments using an azeotrope plus excess steam, the slope of line 42 within the leached volume is constant. Thus, using a mixed vapor, without superheat, leaves the leached volume filled with liquid water (to the irreducible water level) and nearly isothermal throughout the cleansed sand except in the condensation zone 40. In this zone 40, where the water vapor barrier modestly impedes translation of working vapor to the mixing zone 36, there is a temperature gradient, bounded at interface 32 by the saturation temperature of the most volatile portion of the working fluid and determined at the interior boundary of the water vapor layer 40 by the saturation temperature for the least volatile component.

This temperature gradient, across condensation zone 40, may be advantageously exploited for controlling condensation conditions adjacent the interface 32, to regulate thereby several dependent variables including cylindricity of the interface 32, MSOR, tar-extraction rate, and the rate of production of total liquids. In accordance with one preferred embodiment of my process I use a mixed working vapor in which the hydrocarbon-solvent component includes at least two different hydrocarbons species having different boiling points. For example, one may use benzene having an atmospheric-pressure boiling point of about 172° F. in combination with hexane having a boiling point of about 155° F. When a minute quantity of solvent vapor comprising these two species moves through the leached volume 34 and approaches the condensation zone 40 the least volatile component will begin condensing first and the most volatile component, ie. the hexane, will condense last and, therefore, more closely adjacent interface 32, at the inside surface of the mixing layer 36.

By varying the benzene/hexane ratio of this two component volatile solvent one may move a majority of the condensation either closer to or further away from the mixing zone. For example, if the hexane content of the hydrocarbon component is gradually increased from, say, 60% to 80% (with the benzene content being reduced from 40% to 20%), a much larger fraction of the hydrocarbon-solvent component will condense almost directly at interface 32. This result will tend to increase gradually the solvent to oil ratio of the liquids in the mixing zone, decrease the rate at which tar is extracted, and increase the mass flow rate of total liquids produced. It will also tend to modify the cavity shape: when the hexane content is increased, extraction in upper reaches of the leached volume will progress more slowly so that the leached volume will tend to gorw more cylindrically. Conversely, if the hexane content is reduced the leached volume will tend to become more saucer-shaped as it grows larger. Thus, in accordance with this preferred embodiment of my invention, one may adjust the aromatic-paraffinic ratio of the hydrocarbon-solvent component of the mixed vapor to control the shape of the production zone, regulate the MSOR in the mixing zone, control the extraction rate at the interface, and/or regulate the mass flow rate of produced liquids. One may similarly regulate the mole fractions of any two or more hydrocarbons species in a hydrocarbon-solvent component containing more than two species having different volatilites.

Recovery of solvent/heavy crude liquids from the formation by pump 22 requires an adequate liquid head within sump 24. Accordingly, pumping may be interrupted, from time to time, to permit the liquid head of the solvent/heavy crude mixture to rise to an adequate level, or the pumping rate may be adjusted, as needed. Alternatively, if the operating pressure in the leached volume is sufficient to lift produced liquids in production tubing 20, the total-liquids production rate may be regulated, conventionally, by a valve at the surface.

At the surface, the solvent/heavy crude mixture is subjected to treatment for separation of a substantial part of the solvent and entrained water from the crude. Thereafter, the recovered solvent can be re-heated, mixed with a desired amount of steam, and returned to the formation for reuse in the process.

A single well having a leached cavity about 480 feet in diameter and a height of about 100 feet will produce about 600,000 barrels of heavy crude during its practical lifetime. Operating at a higher temperature will provide a higher crude production rate, but require a larger inventory of solvent and yield a lower thermal efficiency. The crude/solvent mixture, as pumped, is more dilute at higher operating temperature, i.e. the MSOR is higher. This higher MSOR reduces the time required to produce a given quantity of heavy crude, but increases the required investment in solvent inventory present in the system. Thus, the optimum operating temperature depends on economic factors, such as prevailing labor rates, cost of working capital, engineering factors such as vertical and horizontal distance from surface plant to formation, solvent formulation and cost, and such resource characteristics as overburden thickness and temperature, pay zone thickness and temperature, heavy crude composition, and age and size of the well.

THE INITIATION ZONE

In practice, it may take from several days to several weeks to establish stable temperature and pressure conditions within the initiation zone 28 so that condensation takes place primarily at its periphery and closely adjacent the tar-sand interface. To some extent, the length of time required will depend on the depth of the well and the corresponding magnitude of the transient well bore heat losses to be overcome to assure that saturated vapor exists all along the slotted liner. When this condition is met, the saturated vapor flows radially outward to the periphery of the initation zone to condense primarily at the initial leaching interface. During this start up transient condition, preceding steady-state operation of the process, there exists a substantial pressure difference between the well head vapor source and condensation conditions at the interface. If the mass flow rate of the incoming vapor were not limited, condensate flooding of the initiation zone and the slotted liner might occur. Such flooding is to be avoided, since the resulting liquids in the initiation zone would tend to impede vapor flow toward the interface 32. The flow of incoming vapor is therefore restricted to assure umimpeded vapor flow throughout the initiation zone to the interface.

To maximize the initial liquids production rate, the initiation zone preferably is made as large practical utilizing conventional well completion practices. Thus, the region of the initiation zone and sump are enlarged, after drilling, by an underreaming procedure. For example, underreaming to a diameter of 26 inches can be accomplished through a 13⅝ inch casing diameter, by the use of commercially available tools. Alternatively, larger diameter underreamed cavities may be formed by the use of hydraulic jet mining techniques employing apparatus which can be operated through the well bore casing. The effectiveness of tools and procedures for forming a large diameter underreamed cavity will depend on the physical characteristics, including the degree of consolidation, of the resource materials encountered along the length of the pay zone of interest. Accordingly, the diameter of the initiation zone one should employ depends on the characteristics of the resource and the economics of incurring relatively high costs in forming a large diameter initiation zone in order to achieve high production soon after start up. The minimum diameter of the initiation zone should be sufficient to provide a region of liquids-free, high permeability material between the slotted liner 19 and the initial location of the mixing zone, so that vapor can flow to all portions of the leaching interface without being impeded by downflowing liquids.

In lower portions of the underreamed cavity, i.e. in the sump region 24, the initiation zone provides high permability for liquids flowing to the sump. Its diameter should provide sufficient peripheral area to accommodate downward and inward flow of liquids from the mixing layer to the sump. In the sump region, the vertical dimension of the gravel pack should be sufficient to provide a hydraulic head sufficient to maintain continuous liquid flow to the pump. Initial leaching rates, under steady state operation, will be relatively low and, therefore, the level of the produced liquids in the sump may be kept relatively low to facilitate radial growth in the adjacent leached volume 34. Later in production from the well, when the liquid flow rates are higher, leached volume 34 provides a more than adequate pathway for liquids flowing from the mixing zone to the sump 24.

Preferably, the initiation zone is formed by placing a body of permeable material, e.g. a gravel pack, in underreamed cavity 26 around the slotted liner 19 after the well is drilled, cased and underreamed. With the liner 19 and tubing 20 set in place, a slurry containing aggregate is flowed into the cavity 26. The liquid portion of the slurry drains into the slotted liner and is removed to the surface while the aggregate remains outside the liner 19 and fills the underreamed cavity. When the underreamed cavity is completely filled with aggregate, throughout the sump 24 and the initiation zone 28, the resulting gravel pack is flushed to remove any remaining slurry liquids and develop maximum permeability. The size of the particulate material forming the gravel pack is chosen to maximize permeability for liquids drainage without permitting substantial migration of viscous tar or cleansed sand from the leached volume into the gravel pack. Preferably, the final porosity of the initiation zone is sufficiently high so that clays and fines carried by the liquids produced will pass through the sump and be removed to the surface.

In summary, the initiation zone 28 is a porous body of solids that performs four distinct functions: it provides a path for umimpeded flow of incoming vapor from liner 19 to all parts of leached volume 34; it provides a relatively large leaching interface, at its periphery, to enable commercially practical leaching rates soon after start up; it provides a path for gravity drainage of liquids, along the initial interface and to the sump, without impeding radial flow of incoming vapor; and it physically supports the cleansed sand in leached volume 34 to thereby avoid any possibility of slumping that would tend to plug portions of liner 19.

ALTERNATIVE EMBODIMENTS

Figure 3A:
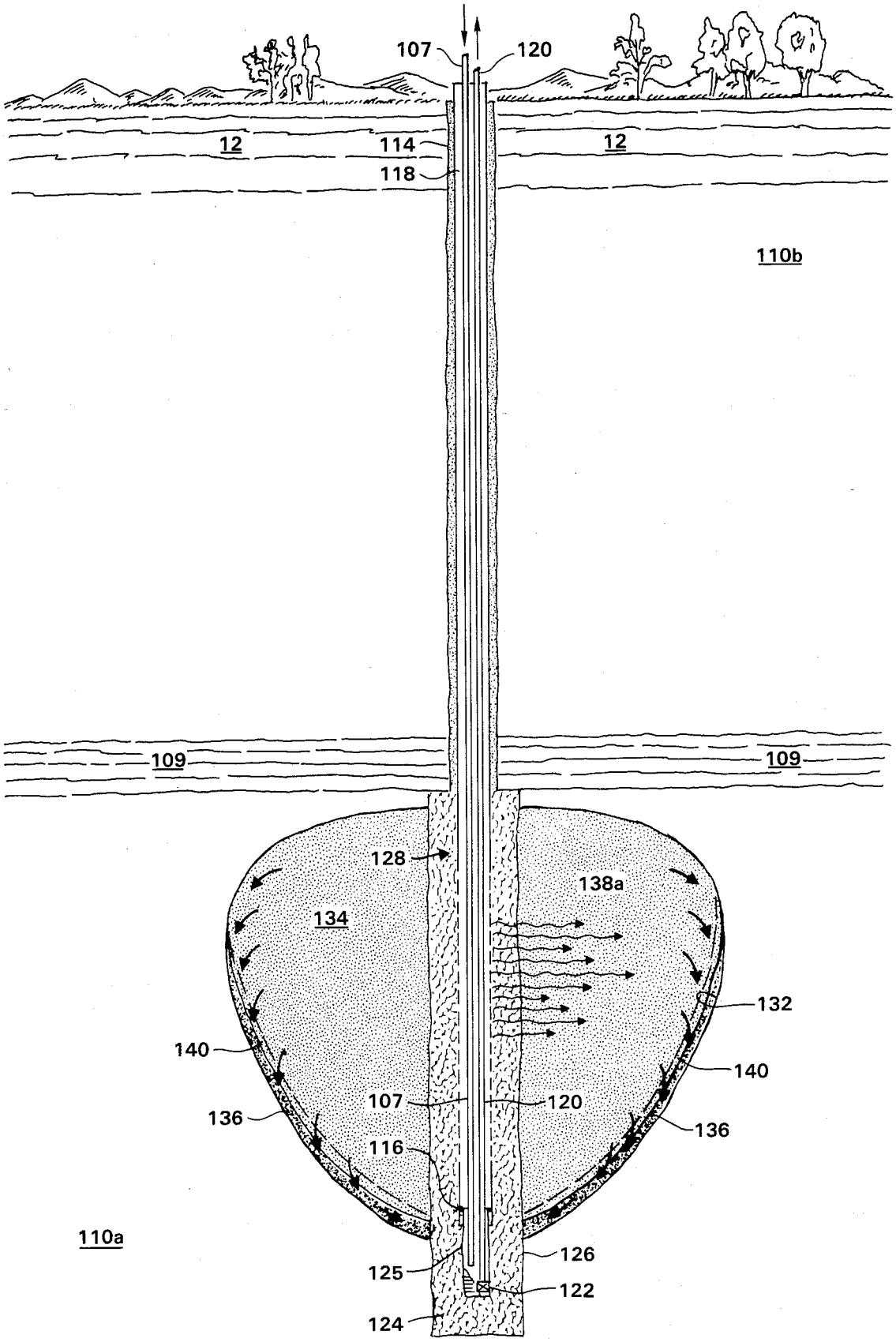
FIGS. 3*a* and 3*b* are schematic, sectional views of a single well bore extending into a tar-sand formation and illustrating recovery of tar firstly from a lower portion of the tar-sand formation and subsequently from an upper portion.
Figure 3B:
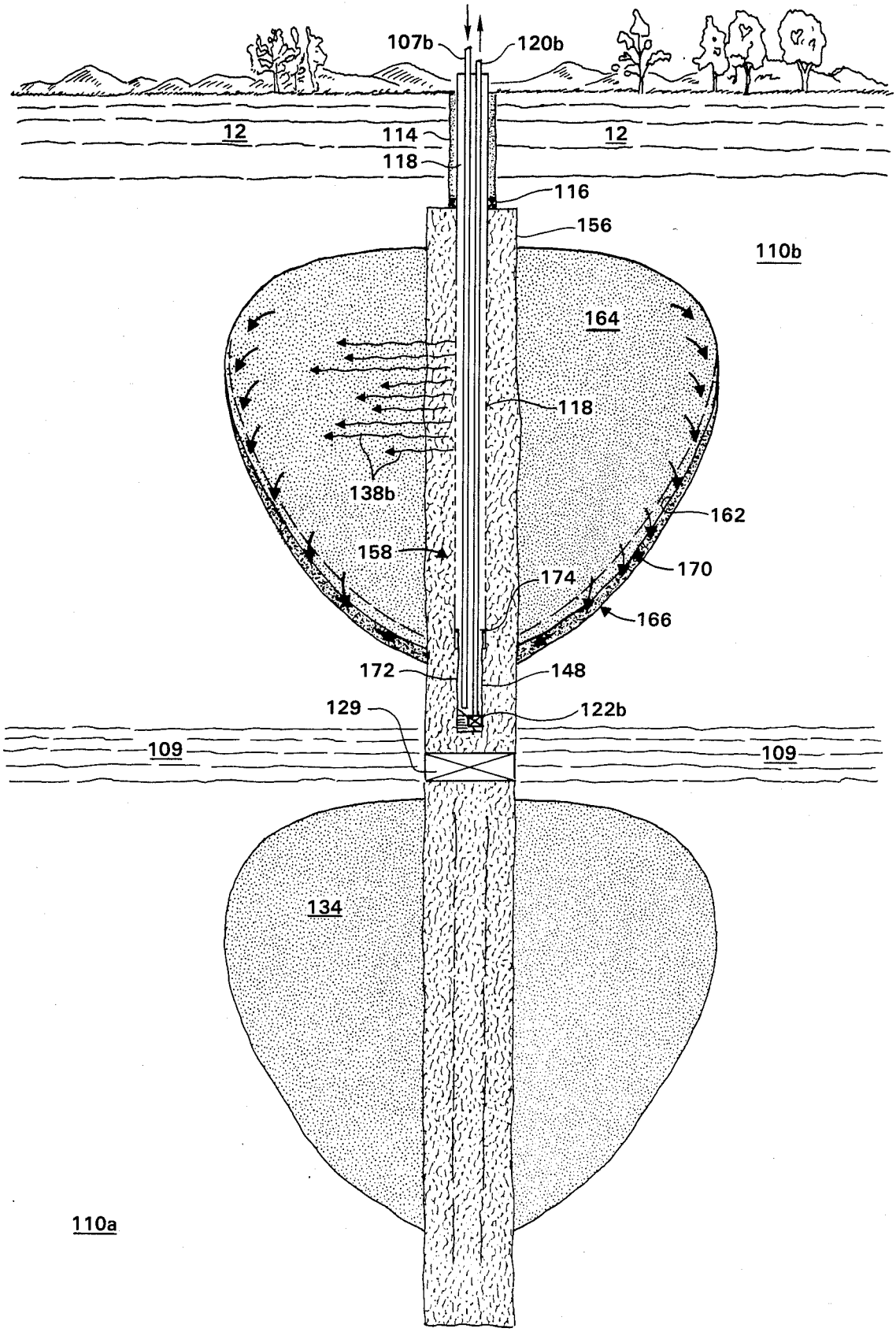

FIGS. 3*a* and 3*b* illustrate an alternative implementation of my invention which may be particularly advantageous if the specific formation contains a relatively impermeable layer 109. After forming well bore 114 downwardly through the upper portion 110*b* of the formation, through layer 109 and a substantial distance into the lower portion 110*a*, casing 118 is inserted and the upper portion thereof is cemented with a conventional cement squeeze. An under-reaming tool is used to form an enlarged-diameter cavity 126 extending from the bottom of the bore hole 114 upwardly to the impermeable layer 109, and this cavity is filled with gravel to form a gravel pack initiation zone 128, functionally like the gravel pack 28 of FIG. 1. Foraminous means comprising a wire wrapped cylindrical screen 125 is joined to the bottom end of casing 118 and extends downwardly from slightly below the bottom of layer 109 to near the bottom end of the gravel pack 126.

Similarly to the prior description of FIG. 1, superheated solvent vapor is fed to formation 110*a* through downcomer conduit 107 and flows outwardly into the lower portion of the formation through the initiation zone 128. The vapor travels to the boundary of the initiation zone 128, condenses on the surface of tar-sand-containing regions at this boundary, and solvates the tar, forming a solvent/crude mixture which flows downwardly and inwardly toward the foraminous screen 125 in the sump 124. From the sump zone, pump 122 lifts this mixture to the surface for separation of crude from the solvent.

Thus, the lower portion 110*a* of the formation, surrounding the initiation zone 128, is leached substantially as described in conjunction with FIG. 1 to form an enlarged, tar depleted leached volume 134. When this volume reached a maximum practical diameter, this lower portion 110*a* of the formation is abandoned and the operation is moved up to the next higher stratum of tar-sand, above impermeable layer 109, to repeat the leaching operation in the upper portion 110*b* of the tar-sand formation (FIG. 3*b*).

More specifically, as shown in FIG. 3*b*, the operation is moved up to tar-sand stratum 110*b* by removing the downcomer tubing 107 and production tubing 120 and inserting a bridge plug 129 at the elevation of impermeable layer 109 to seal the hole against leakage of fluids downwardly from the bottom of portion 110*b*. A verticallyextending portion 148 of the casing is milled away and the tar-sand in upper portion 110b of the formation is underreamed to form an enlarged-diameter cavity 156. This cavity is then filled with a vertically and horizontally permeable gravel pack 158, extending upwardly from bridge plug 129. This new gravel pack 158 functions as a new initiation zone through which solvent vapor may be introduced to leach hydrocarbons from the upper portion 110*b* of the tar-sand formation. To implement this leaching process a second wire wrapped screen 172 is positioned in cavity 156 and secured to the casing by a gas-tight packer 174. Thereafter the cavity 156 is filled with gravel in substantially the same manner as previously described with reference to FIG. 3*a*, to form the vertically extending initiation zone 158 in the upper portion 110*b* of the formation. A new downcomer tubing 107*b* and production tubing 120*b*, including pump assembly 122*b*, are inserted downwardly with the pump preferably being positioned not more than a few feet above bridge plug 129.

Again, operation of the leaching process by vapor condensation is commenced by introducing working vapor into the new initiation zone 158 from downcomer tubing 107*b*. When initiation zone 158 becomes nearly isothermal, subsequent condensation occurs substantially only in a condensation zone 170 which, initially, coincides with peripheral portions of the gravel pack initiation zone 158. As leaching proceeds, a leached volume 164 of gradually increasing radial extent is formed around initiation zone 158. Thus, production of hydrocarbons from the upper portion 110*b* of the formation may proceed in substantially the same manner as described heretofore in conjunction with FIG. 1 until the leached volume 164 reaches a maximum practical diameter and the formation 110*b* has been deleted of hydrocarbons to any desired radial dimensions.

When hot working vapor is introduced into the isothermal zone it is drawn toward the areas at which condensation is occuring; that is, the areas at the periphery of leached volume 164 that are being cooled by conduction of heat energy outwardly to the undisturbed tar sand. Accordingly, it is not essential that the working vapor be introduced along the axis of symmetry of leached volume 164, or at any other specific portion of this body. Rather, it may be introduced at substantially any portion of the crude-depleted region from which it can flow without substantial impediment to substantially all portions of the periphery of the previously leached volume. Preferably, however, it is introduced approximately at the axis of symmetry of initiation zone 159, within the vertical interval of the formation that has been selected for leaching. Alternatively the vapor may be introduced through a downcomer tubing (not shown) disposed coaxially around the production tubing 120 or through a secondary well extending at least part way through the leached volume 164.

Each of the wire-wrapped screens 125 and 172 preferably comprises a 20 to 40 foot length of conventional tubing which is perforated with $\frac{3}{8}$ inch diameter holes, with about 130 holes per foot of length. Steel rods about ⅜ inch in diameter are spot welded to the surface of this tubing so that they extend longitudinally on the surface and are spaced about ½ inch apart. Over these rods I helically wrap the assembly with 1/16 inch diameter wire with each successive turn being spaced from the prior turn approximately 1/32 to 1/16 inch thereby forming a coarse screen which precludes gravel from passing inwardly from gravel-pack 128 to the pool of liquid within the wire-wrapped screen surrounding pump 122.

Figure 4:
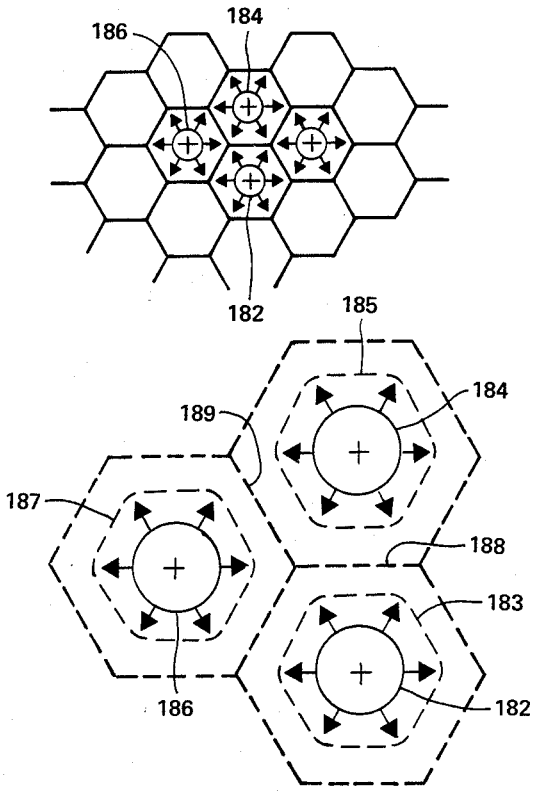
FIG. 4 shows, in plan view, a multiple well method for recovering tar from a single tar sands formation.

To recover the maximum amount of crude from a given tar sands formation, a plurality of wells of the kinds described with reference to FIGS. 1 and 3 may be desirable. As FIG. 4 shows, a plurality of wells in a single tar sand formation will tend to grow towards one another, forming a closely-packed hexagonal array. With a plurality of wells in a single formation, each leached volume will become nearly hexagonal as heat flows from one well toward surrounding wells in the same formation. This growth pattern maximizes the recovery of crude from a single formation and minimizes the total quantity of heat expended to achieve that goal. More specifically, consider the array of wells 182, 184, 186, etc. illustrated in FIG. 4. The growth of leached volume 183 (around well 182) and leached volume 185 (around well 184) depends on condensation adjacent the periphery of each of these leached volumes. But condensation occurs only in regions where the temperature is at least slightly below that of the isothermal leached volume. Thus in areas such as 188 and 189, where the leached volume approach each other, the temperature tends to closely approach isothermal, condensation decreases, and leaching slows. The advantageous result is that leached volumes 182, 184, 186, etc. tend to become hexagonal as they approach the intermedial lines 188, 189. In a large array of wells this characteristic enables continued leaching until almost all of the formation between adjacent wells is leached, the several leached volumes becomes substantially hexagonal, and nearly all the available hydrocarbons have been recovered. If vapor communication from one leached volume to another occurs, my process continues without disruption. Since their operating pressures and temperatures are equal, the several leached volumes will merge to form one large isothermal volume with condensation (and solvent leaching) continuing at all peripheral areas from which heat is conducted to colder portions of the formation.

Figure 5A:
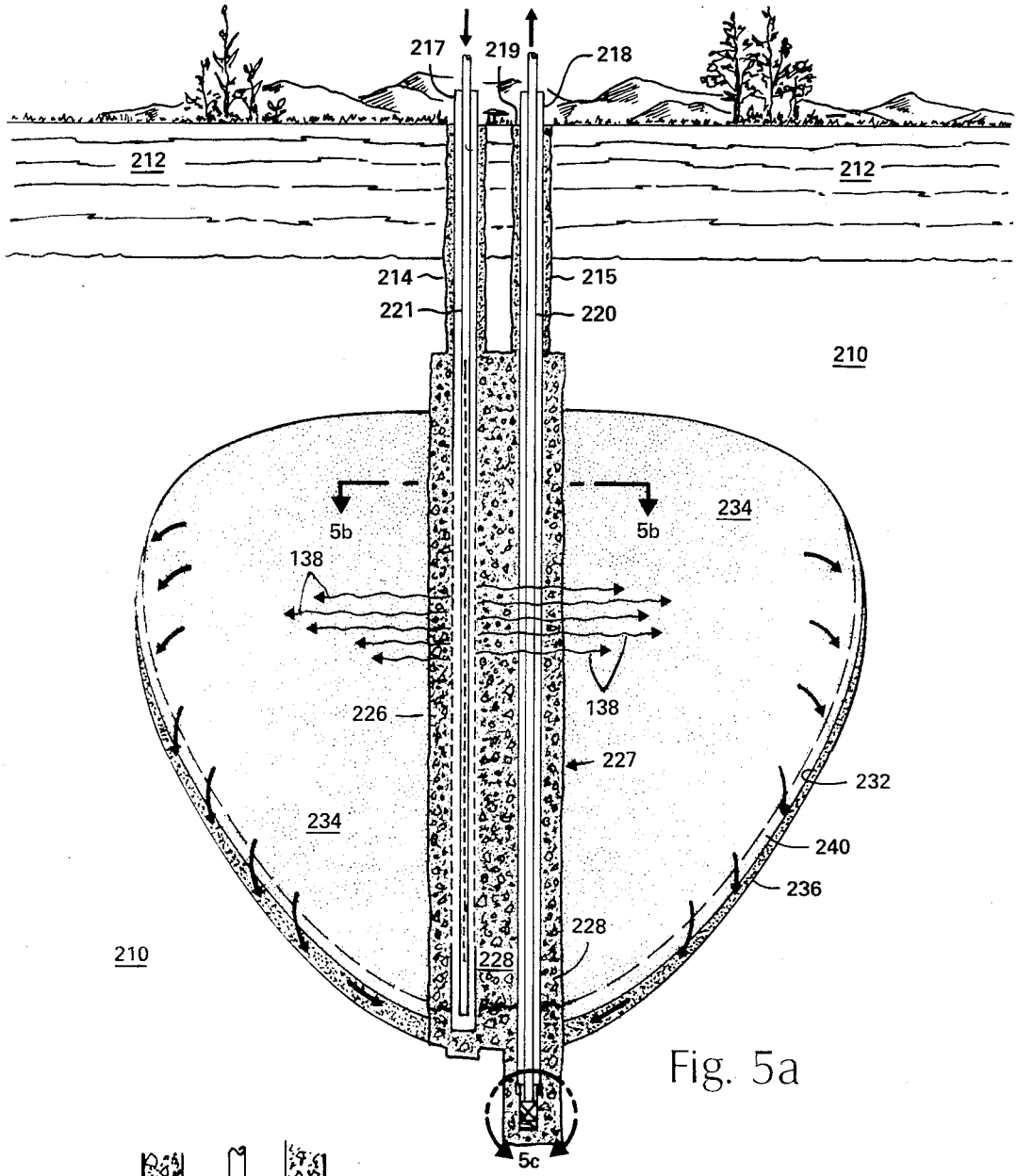
FIGS. 5A, 5B and 5C illustrate, schematically, a further embodiment in which separate well bores are used for introducing vapor and extracting liquid product.
Figure 5C:
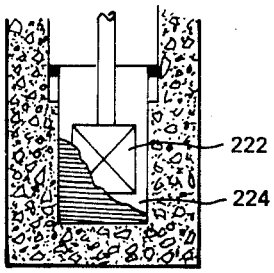
Figure 5B:
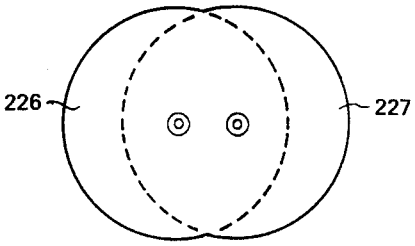

FIG. 5 illustrates a further embodiment of my invention generally similar to that shown in FIG. 1 but differing in that two holes 214 and 215 are drilled side by side through overburden 212 and almost to the bottom of tar sand deposit 210. Both well bores are underreamed over a substantial vertical interval, for example 100 feet, and are provided with casings 217 and 218. The underreamed cavity around each well bore is large enough in diameter so that the underreamed cavities intersect, as shown in FIG. 5*b*. Thus, initiation zone 228 provides fluid communication between the two well bores. Casing 217 is perforated over substantially the entire vertical length of the initiation zone and contains tubing 221 which is slotted or otherwise foraminated to permit introduction of solvent vapor into the gravel-pack initiation zone 228. Casing 218, in well bore 215, is perforated only at its lower end over a length of 10 to 12 feet within the sump 224. Production tubing 220 having at its lower extremity pump 222 is located within casing 218 so that the pump is substantially below the expected level of liquids in the sump. Both well bores are cemented outside the casing as indicated at 219 to seal the casing to the top of the formation 210.

The operation of this embodiment is substantially the same as that heretofore described in connection with FIG. 1, except that solvent vapor is introduced only through downcomer tubing 221 and outwardly through the perforations in casing 217 into the gravel-pack 228, and crude/solvent mixture is produced only from well bore 215 by way of pump 222 and production tubing 220. As leached volume 234 gradually grows larger, radially, it tends to become substantially symetrical about the longitudinal axis of casing 217. Preferably, well bore 215 is somewhat deeper than well bore 214 to provide a pocket or sump 224 at the bottom of the hole. As previously described in conjunction with FIG. 1, a liquid mixture of condensate and heavy crude flows downwardly within mixing zone 236 which is bounded on its outside by the undisturbed tar sand deposit 210 and, on its inside, by the interface 232 between the substantially isothermal leached volume 234 and the mixing zone.

In steady-state operation, from one hole in a tar-sand formation, one can produce solvent/heavy crude mixture at production rates, as the leached volume grows larger, that are limited only by the capacity of the downhole pump. With a conventional sucker-rod pump this practical production-rate limit will be about 4000 barrels per day of mixture. To minimize pumping equipment costs while maximizing production, it is thus desirable to reduce the solvent/bitumen ratio of the produced mixture to the lowest practical values. By regulating the superheat content of the solvent vapors introduced, (or by regulating the water/solvent ratio where a mixed vapor is used) I control the solvent/heavy crude ratio of the produced liquids to hold it within the range from about 2:1 to about 10:1. This choice optimizes the production of heavy crude for a given pumping-equipment installation. In summary, then, in a preferred implementation of my process the superheat content of the working vapor preferably is sufficient to maintain the lowest solvent/crude ratio at which the production mixture flows readily downward through the mixing zone to the sump zone and at which a sufficient hydraulic head is maintained within gravel pack 228 to facilitate continuous pumping from the liquid pool in sump 224.

The end-point for a particular hole using my process occurs when the solvent/heavy crude ratio of the produced liquids becomes commercially unattractive. This end-point may be detected as a substantial increase in the solvent/heavy crude ratio, or a decline in the rate of heavy crude recovery from the formation.

The present invention is applicable and adaptable to many different kinds of heavy crude-containing formations, incuding those containing connate water, non-condensable gases such as carbon dioxide and methane, and discontinuities such as rocks, stringers and clay lenses within the formation. To minimize the effects of foreign bodies, one may adjust the quantity of superheat in the solvent vapor sufficiently to compensate for heat lost warming them. One may utilize additives that absorb, or otherwise neutralize non-condensable gases. To eliminate non-condensable gases from a formation, one may also, from time to time, depressurize the formation to induce backflow of such gases toward the initiation zone for venting to the surface. Venting of such gases, water vapor, or both, can also be effected by convection from the bottom and sides of the heavy crude-depleted regions within the formation.

Non-condensable gas released by the formation will redissolve or become entrained, in part, in the solvent-/heavy crude mixture produced. A buoyancy effect, arising from the different densities of solvent vapor and noncondensable gases, causes the remaining gases and even water vapor to diffuse upwardly in the leached volume. Where such an effect arises, accumulation of these gases may be advantageously manipulated to control leaching rate and/or the shape of the leached volume, as it grows larger. The non-condensable gases moderate the tendency of the heavy-crude depleted regions to grow more rapidly at the top than at the center. By selectively venting non-condensables from the upper regions of the formation, one may control the concentration of such gases within the formation and the rate at which the process removes heavy crude from the formation. This selective venting may be accomplished by any of several techniques such as depressurizing the leached volume or by releasing noncondensable gases through an additional tubing positioned in the casing 18, or through tubulars in separate boreholes spaced from the production well. The higher the concentration of such gases, the slower the rate at which extraction proceeds, and vice-versa. Controlling this rate may be desirable to minimize the tendency of the heavy crude-depleted regions to grow faster in the upper part of the formation than in the lower part.

The action of non-condensable gases being liberated from the undisturbed tar sand may facilitate solvent mobilization of the tar. As indicated by curve 42, in FIG. 1, the temperature of the undisturbed tar sand in the near vicinity of mixing zone 36 rises to a level slightly below that of the mixing layer. This advancing thermal wave brings the unmobilized crude up to near the desired operating temperature. The viscosity of the heavy crude decreases, and its volume increases, owing both to thermal swelling and swelling caused by exsolution of gases from the crude. Escaping gases extrude from the heavy crude-containing regions, impelling the crude towards the mixing layer. Thus, thermally induce volatilization of gases from crude-containing sand outside the mixing zone will tend to promote solvation of crude in the down-flowing condensate and thereby accelerate radial growth of the leached volume, particularly at lower portions of the production zone.

FIELD EXAMPLE

A more complete understanding of my invention may be had by reference to the following field example, which is offered as an illustrative implementation of the concepts. It is not to be construed as restricting my invention to any specific formation, structure, method or operating parameters.

Evaluation of a specific tar-sand property reveals that the pay zone is at a depth of about 500 feet and has a thickness of 50 feet. It is clearly not suitable for strip mining. The petroleum is present in the resource in the form of viscous tar having an API gravity of about 6°, with this tar filling the interstices between sand grains in a substantially consolidated mass consisting of 85 weight percent solids, and about 12 weight percent bitumen with the balance being connate water. The lithostatic pressure in the pay zone is in the range from 300–500 psig and an undisturbed sample of the resource sand, after the bitumen is removed, has a nearly uniform permeability in the range from 700–1000 millidarcies.

The objectives of the field program are to recover at least 60% of the resource hydrocarbons over a 350' diameter within 6 years, maintain a mixed solvent/oil ratio in the produced liquids within the range from about 2:1 to about 6:1, minimize the inventory of hydrocarbon solvents required, and leave the leached volume containing as much water as reasonably practicable without unduly limiting its permeability for vapor throughput and liquids drainage.

A well bore is drilled nearly to the bottom of the pay zone, cased to the top of the tar-sand and completed with a wire-wound screen, foraminated tubing, and a peripheral initiation zone, generally as described above in connection with FIG. 1. The well is also equipped with a conventional pump positioned in a gravel-packed sump at the bottom of the hole.

The initiation zone is first filled with hot water together with about 15 barrels of naphtha, after which pumping is initiated to draw down the liquids and, simultaneously, a mixed vapor comprising about 50 mole percent naphtha and 50 mole percent steam is allowed to flow from a surface-located vapor supply source, via the foraminated tubing, outwardly into the permeable initiation zone. Vapor introduction is continued while the liquid level is drawn down to a few feet above the top of the sump. Condensation of steam and hydrocarbon solvent in the initiation zone is continued until this zone becomes substantially isothermal; thereafter, condensation occurs substantially only at the tar-sand interface, initially adjacent the initiation zone, and the solvent condensate mixes by mass diffusion with tar from the resource to form a downwardly-flowing stream of liquids contiguously adjacent the as yet unleached resource. Pumping is continued either continuously or intermittently to maintain the pool of liquids, in the sump, between predetermined minimum and maximum levels. The mass flow rate of vapor introduced is continuously determined by the rate of condensation at the periphery of the leached volume. The operating temperature and pressure in the leached volume are maintained at 350° F. and 273 psia with the hydrocarbon solvent/steam ratio of the input vapor being regulated to maintain the mixed-solvent to oil ratio of the produced liquids between about 2:1 and about 6:1.

After three years of quasi-steady state operation at the foregoing conditions the total liquids production rate and the bitumen production rate have reached, respectively, 620 bbls per day and 130 bbls/day. Thermocouples disposed in radially spaced instrumentation bore holes indicate that the isothermal leached volume has grown to a radius of about 115 feet. The cumulative total of bitumen recovered is 105,00 bbls and the inventory of hydrocarbon-solvent vapor contained within the leached volume has increased to about 5000 bbls of liquid-solvent equivalent.

At this time, production may be continued on a quasi-steady state basis. The produced mixture of hot water and solvent/bitumen solution are separated at the surface for recycling the solvent to the well as a near-azeotropic mixture of solvent vapor and water vapor. Bitumen is processed, nearby, to provide make-up naphtha to the production operation and derive marketable product.

While only certain embodiments of my invention have been illustrated and described, it will be understood by those skilled in the art that my invention is not limited to these specific embodiments but is susceptible of various modifications and changes without departing from the true spirit and scope thereof.

I claim:

1. In a process for recovering hydrocarbons from a tar-sand or crudecontaining resource which in its native state is substantially impermeable to liquids and gas, the steps of:

(a) forming at least one well bore extending through a selected interval of the resource;

(b) providing a sump from which liquids may be removed to the surface;

(c) providing means for recovering liquids from the sump to the surface;

(d) forming, within said interval, a porous body of substantially crude-free solids, having an average diameter larger than the well bore and at least several times longer than its average diameter, with said body being substantially impermeable to solids and native-state crude while being sufficiently permeable to liquids and gas to permit flow of vapor outwardly from the well bore and flow of liquids downwardly from the surrounding resource to the sump;

(e) filling said porous body with water, hydrocarbon solvent, or a mixture of solvent and water to displace substantially all air and other noncondensable gases from said porous body;

(f) removing liquids from said sump and simultaneously introducing hot working vapor into said porous body, until the level of the liquids in said porous body are drawn down to approximately the top of the sump, with said working vapor being a mixture of steam and at least 40 weight percent vapor of a hydrocarbon solvent, which solvent includes at least 20% of weight aromatic hydrocarbons;

(g) thereafter continuing the introduction of said working vapor through said porous body in a manner such that the hydrocarbon-solvent component condenses adjacent to crude containing portions of the resource and forms a mixture of liquid solvent and crude having a sufficiently reduced viscosity to flow downwardly to the sump, thereby leaving in place a vapor-filled leached volume of crude-depleted solids from which substantially all of the crude has been removed; and (h) regulating the composition of the working vapor to maintain the MSOR of the produced liquids within a predetermined range.

2. In a process for the recovery of hydrocarbons from a tar sand or crude containing crude formation, the steps of:

(a) forming a well bore in the formation;

(b) providing a sump from which liquid product may be recovered to the surface;

(c) providing permeable means extending radially outward from the well bore for permitting working vapor to flow toward peripherally adjacent portions of the formation;

(d) introducing into the formation, through the bore and said permeable means, a mixed working vapor comprising a hydrocarbon-solvent vapor component and water vapor;

(e) controlling the temperature, pressure, and composition of the mixed vapor so that the solvent vapor component condenses predominately in a condensation zone adjacent the interface between leached and unleached portions of the formation to provide a condensate which mobilizes hydrocarbons by heat and solvating action and forms a reduced-viscosity liquid mixture of solvent and hydrocarbons flowing downwardly through said permeable means thereby leaving in place a slowly enlarging leached volume of solids from which most of the hydrocarbons has been removed;

(f) removing reduced-viscosity liquid mixture from the sump; and (g) separating hydrocarbon product from said mixture and returning the solvent to the well bore with enough water vapor to provide the mixed working vapor called for in step (c).

3. The process of claim 2 where at least 40 weight percent of the mixed vapor is vapor of a solvent for hydrocarbon constituents of the formation.

4. The process of claims 2 or 3 where the amount of water vapor present in the mixed vapors is controlled so that there remains in the leached volume an amount of water essentially equal to the irreducible level.

5. The process of claim 2 or 3 where operating conditions are controlled so that an azeotropic mixture of hydrocarbon solvent and water condenses at the leaching interface.

6. The process of claim 2 wherein the MSOR is maintained between about 2:1 and about 10:1.

7. The process of claim 2 where the hydrocarbon solvent vapor comprises at least 20% by weight aromatic hydrocarbons.

8. In a process for the recovery of hydrocarbons from a tar sand or crude-containing formation, the steps of:

(a) forming a well bore extending into the pay zone of said formation and a sump from which liquids may be recovered to the surface, (b) surrounding at least a portion of the bore with a porous structure which is substantially impermeable to solids but permeable to liquids and gases, said structure being substantially longer than its width and providing a pathway for permitting working vapor to flow toward peripherally adjacent portions of the formation and support for that portion of the resource from which hydrocarbons have been extracted, (c) introducing into the formation through said porous structure a hot working vapor comprising hydrocarbon solvent in a manner such that it condenses primarily in a condensation zone adjacent the tar or crude containing portions of the formation and forms a mixture of liquid solvent and heavy crude sufficiently mobile to flow downwardly through said permeable means, leaving in place a vapor-filled, permeable, leached volume of solids from which most of the hydrocarbons has been removed, and (d) removing liquid mixture of hydrocarbons and solvent from the sump.

9. The process of claim 8 wherein steady-state leaching is initiated by:

(a) filling said porous structure with a mixture of liquid solvent and water, and (b) thereafter removing substantially all of said mixture from said porous structure and simultaneously filling it with said working vapor until all portions of said structure become substantially isothermal and substantially free of retained liquids.

10. In a process for recovery of hydrocarbons from a tar sand or crude-containg resource, the steps of:

(a) forming a well bore extending into the pay zone of said resource and a sump from which liquids may be recovered to the surface;

(b) providing permeable means surrounding and extending radially outward from the well bore within a selected interval of the pay zone for permitting vapor to flow toward peripherally adjacent portions of the formation;

(c) filling the well bore and said permeable means with a mixture of liquid hydrocarbon solvent and liquid water;

(d) removing said liquids from the sump while simultaneously introducing working vapor into the well bore and said permeable means until substantially all portions of said permeable means become substantially isothermal at a temperature and pressure such that said working vapor condenses primarily in a condensation zone located adjacent the tar or crude-containing portions of the formation surrounding said permeable means; and (e) thereafter continuing the introduction of mixed working vapor, comprising hydrocarbon solvent and water, with the working vapor's temperature, pressure and composition being controlled in a manner such that the vapor's hydrocarbonsolvent component condenses adjacent crude containing portions of the resource and forms a mixture of liquid solvent and crude having a sufficiently reduced viscosity to flow downwardly to the sump, thereby leaving in place a vapor-filled leached volume of solids from which substantially all of the crude has been removed.

11. The process of claim 10 wherein the working vapor is mixed vapor comprising at least 40 weight percent hydrocarbon solvent, water vapor, and negligible amounts of noncondensable gas.

12. In a process for producing heavy crude from a heavy crude-containing formation which in its native state is substantially impermeable to liquids and gas, the steps of:

(a) forming a well bore extending into a selected interval of the formation;

(b) forming a sump from which liquids may be recovered to the surface, (c) providing a production tubing extending downwardly along said well bore for recovering liquids from said sump;

(d) forming within said interval a permeable body of substantially crude-free particulate solids said body extending radially from the well bore to provide a path for flow of vapor outward from the well bore and flow of liquids downwardly to the sump;

(e) introducing working vapor downwardly along said well bore and outwardly through said permeable body under controlled conditions such that (1) said vapor condenses substantially only within a condensation zone located immediately adjacent the interface between leached and unleached portions of the formation, (2) the resulting condensate mixes with heavy crude, and (3) the resulting mixture drains by gravity flow along said interface to the sump, thereby leaving in place a slowly enlarging, vapor-filled leached volume of particulate solids from which substantially all of the heavy crude has been recovered.

13. A process in accordance with claim 12 wherein:

(a) a selected interval of the well bore is laterally enlarged by underreaming, (b) the under-reamed portion is filled with gravel to form a liquids-permeable initation zone extending to the inner surfaces of the impermeable, crude-containing portions of the formation.

14. A process in accordance with claim 12 wherein the sensible heat content of the working vapor is regulated to maintain a desired solvent/crude ratio in the liquids recovered.

15. A process in accordance with claim 12 wherein the composition of the working vapor is regulated so that at least 50% by weight of the working vapor condenses immediately adjacent the periphery of said leached volume.

16. A process in accordance with claim 12 wherein the working vapor's superheat is regulated to keep the condensation zone substantially coincident with the periphery of the previously leached volume.

17. A process in accordance with claim 12 or 16 wherein at least the hydrocarbon-solvent component of the working vapor condenses substantially at the interface between the leached volume and the crude-containing portions of the formation.

18. A process in accordance with any one of claims 13, 14, 15, or 16 wherein the working vapor is hydrocarbon-solvent vapor mixed with at least enough water vapor to form an azeotrope, at the pressure and temperature maintained within the leached volume, as the working vapor approaches the condensation zone.

19. A process in accordance with any one of claims 12 through 16 wherein the pressure maintained within the leached volume is equal to or less than the pressure initially present at the bottom of the selected interval of the formation.

20. A process in accordance with any one of claims 12, 14, 15, and 16 wherein said permeable body of substantially crude-free particulate solids is formed by (a) under-reaming a portion of the well bore to form an enlarged-diameter cavity within a selected interval of the formation; (b) attaching a foraminous member to the bottom end of the casing within said sump; (c) positioning pumping means within said foraminous member; and (d) filling the enlarged-diameter cavity, outside said foraminous member, with particulate solid material.

21. A process in accordance with any one of claims 12, 13, and 15 wherein the composition of the working vapor is regulated to maintain in the produced liquids a solvent/heavy crude ratio within the range from about 2:1 to about 10:1.

22. A process in accordance with claim 14, 15 or 16 wherein the superheat of the working vapor is regulated to maintain, in the produced liquids, a solvent/heavy crude ratio within the range from about 2:1 to about 10:1.

23. A process in accordance with claim 12 or 13 where the water vapor/solvent vapor ratio of the working vapor is regulated to maintain the MSOR within the range from 2:1 to 10:1.

24. A process in accordance with any one of claims 12 through 16 wherein the working vapor employed is an azeotropic mixture of water vapor and vapor of a volatile hydrocarbon solvent which includes at least 20% by weight aromatic hydrocarbons.

25. The process of claim 23 where the MSOR is maintained between 2:1 and 6:1.

26. In a process for recovering heavy crude from a formation which in its native state is substantially impermeable to liquids and gas, the steps of:

(a) forming a well bore extending into the pay zone of said formation;

(b) providing permeable means extending radially outward from the well bore for permitting solvent vapor to flow toward peripherally adjacent portions of the formation; and (c) introducing vapor through said permeable means in a manner such that is condenses primarily in a condensation zone adjacent heavy crude-containing portions of the formation and forms a mixture of liquid solvent and heavy crude sufficiently mobile to flow downwardly and inwardly through said permeable means toward said well bore, leaving in place a vapor-filled, permeable, leached volume of crude-depleted solids from which substantially all of the heavy crude has been removed.

27. A process in accordance with claim 26 wherein said permeable means comprises a body of gas- and liquid-permeable material substantially filling a radially-enlarged portion of the well bore for (a) permitting flow of vapor radially outward from the well bore to crude-containing portions of the pay zone and (b) enabling flow of said mixture downwardly along a mixing zone located at the periphery of said vapor-filled, permeable volume of crude-depleted solids.

28. The process of claim 26 wherein said permeable means comprises a porous body of particulate material filling the space surrounding a substantial portion of the well bore for permitting flow of solvent vapor from the well bore outwardly into the formation and permitting flow of solvent-crude mixture downwardly and inwardly through said body adjacent the interface between the leached volume and the surrounding, heavy crude-containing, portions of the formation.

29. In a process for recovering crude from a crude-containing formation which in its undisturbed state is substantially impermeable to liquids and gases, the steps of:

(a) forming a well bore extending into the formation:

(b) forming an initiation zone that is relatively very permeable to liquids and gases around at least a portion of the well bore and extending radially outward for permitting working vapor to flow toward peripherally adjacent portions of the formation;

(c) introducing heated working vapor into said initiation zone in a manner such that it condenses intially near the periphery therof, leaches heavy crude from the formation, produces a reduced-viscosity mixture of condensate and heavy crude flowing downwardly through the initiation zone, and leaves in place a vapor-filled, leached volume of crude-depleted solids from which substantially all of the heavy crude has been removed;

with said working vapor being a mixture of water vapor and vapor of a hydrocarbon solvent in proportions such that it forms a steam-solvent azeotropic component plus some excess water vapor and with its water/solvent ratio being regulated to gradually increase the enthalpy of the mixed vapor, independently of its mass-flow rate as the leached volume grows larger, so that said azeotropic component is constrained to condense substantially only within a condensation zone located adjacent the interface face between the leached volume and the surrounding, crude-containing portions of the formation.

30. A process in accordance with claim 29 wherein the working vapor is vapor of a hydrocarbon solvent mixed with water vapor with the water/hydrocarbon ratio of said working fluid being regulated so that the rate at which heat energy is fed to the leached volume is sufficient to keep the condensation zone located closely adjacent the periphery of the leached volume.

31. The process of claim 29 wherein the working vapor is introduced at a pressure equal to or less than the hydrostatic pressure initially present at the bottom of the heavy crude containing formation.

32. In a process for producing heavy crude from a heavy crude-containing formation which in its native state is substantially impermeable to liquids and gas, the steps of:

(a) forming a well bore extending into a selected interval of the formation;

(b) forming a sump at the bottom of said well bore;

(c) providing a production tubing extending downwardly along said well bore and pumping means for recovering liquids from said sump;

(d) forming within said interval a permeable body of substantially crude-free particulate solids substantially larger, in diameter, than the well bore, said body extending radially outward from, and peripherally surrounding, the production tubing for permitting flow of vapor radially outward from the well bore and enabling the flow of liquids downwardly substantially at the periphery of said body;

(e) introducing working vapor downwardly along said well bore and outwardly through said permeable body under controlled conditions such that (1) said vapor condenses substantially only within a condensation zone located immediately adjacent the interface between leached and unleached portions of the formation, (2) the resulting condensate mixes with heavy crude, and (3) the resulting mixture drains by gravity flow along said interface to the sump, thereby leaving in place a slowly enlarging, vapor-filled leached volume of particulate solids from which substantially all of the heavy crude has been recovered.

33. A process in accordance with claim 32 wherein the working vapor is a mixture of water vapor and a hydrocarbon solvent suitable for reducing the viscosity of the heavy crude.

34. A process in accordance with claim 32 wherein:

(a) a selected vertical interval of the well bore is laterally enlarged by under-reaming.

(b) the under-reamed portion is filled with particulate material to form a liquids-permeable gravel pack extending to the inner surfaces of the impermeable, crude-containing portions of the formation, and (c) a mixture of condensate and heavy crude flows downwardly and inwardly through said gravel pack to the sump at the bottom of the well bore.

35. A process in accordance with claim 32 wherein the heat content of the working vapor is regulated to maintain a desired solvent/crude ratio in the liquids produced.

36. A process in accordance with claim 32 wherein the degree to which the working vapor is superheated is regulated to assure that substantially all of the hydrocarbon solvent is in the form of saturated vapor as it reaches the interface between said leached volume and the peripherally surrounding crude-containing portions of the formation.

37. A process in accordance with claim 36 wherein the superheat is maintained sufficiently high so that substantially all of the solvent reaches the periphery of the leached volume at a temperature incrementally higher than the condensation temperature of the solvent for the operating pressure existing within the leached volume.

38. A process in accordance with claim 32 wherein the enthalpy of the working vapor is varied from time to time to control the relative rates at which vertically-spaced portions of the leached volume grow larger, radially.

39. A process in accordance with claim 32 wherein the enthalpy of the working vapor is regulated, continuously, to keep the condensation zone substantially coincident with the periphery of the previously leached volume.

40. A process in accordance with any one of claims 32 through 39 wherein the hydrocarbon solvent component of the working vapor condenses substantially at the periphery of the previously leached volume, deposits its latent heat of vaporization into the solids at said periphery, mobilizes heavy crude both by thermal softening and by solvation and mixes with the so-mobilized crude to form a downwardly-flowing stream comprising a mixture of solvated crude and liquid solvent.

41. A method in accordance with any one of claims 32 through 39 wherein a plurality of well bores are formed in the same crude-containing formation, each well bore is provided with a permeable body of substantially crude-free particulate solids, and heavy-crude is leached from the formation surrounding each permeable body until the leached volumes formed around the several well bores approach each other, the intermediate regions of crude-containing formation between adjacent leached volumes are heated to temperatures approximating that of the leached volumes, the rate of leaching of these intermediate regions decreases and each leached volume grows toward a substantially hexagonal shape.

42. A process in accordance with any one of claims 32 through 39 wherein the pressure at which the working vapor in introduced is maintained substantially constant and the vapor mass flow rate equals the mass rate of condensation occuring within the leached volume, plus a quantity per unit of time sufficient to account for the increasing volume of the vapor-filled, crude depleted region.

43. A process in accordance with claim 33 wherein the hydrocarbon solvent component of the working vapor is a volatile hydrocarbon selected from the group consisting of cycloparaffins, benzenes, xylenes, toluenes and blends of the foregoing.

* * * * *